US009605682B2

(12) United States Patent
Hasegawa et al.

(10) Patent No.: US 9,605,682 B2
(45) Date of Patent: Mar. 28, 2017

(54) BLOWER FAN

(71) Applicant: NIDEC CORPORATION, Kyoto (JP)

(72) Inventors: Tomohiro Hasegawa, Kyoto (JP); Shunji Matsumoto, Kyoto (JP); Takahiro Kikuichi, Kyoto (JP); Mitsuhito Nishio, Kyoto (JP); Noriaki Yamada, Kyoto (JP); Satoru Otsu, Kyoto (JP); Hiroyoshi Teshima, Kyoto (JP); Kiyoto Ida, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 14/887,903

(22) Filed: Oct. 20, 2015

(65) Prior Publication Data

US 2016/0032929 A1 Feb. 4, 2016

Related U.S. Application Data

(63) Continuation of application No. 13/482,754, filed on May 29, 2012, now abandoned.

(30) Foreign Application Priority Data

| | | |
|---|---|---|
| Jun. 30, 2011 | (JP) | 2011-146730 |
| Nov. 4, 2011 | (JP) | 2011-242502 |
| Mar. 16, 2012 | (JP) | 2012-060726 |

(51) Int. Cl.
*F16C 32/06* (2006.01)
*F04D 25/06* (2006.01)
(Continued)

(52) U.S. Cl.
CPC ..... *F04D 25/062* (2013.01); *F04D 17/16* (2013.01); *F04D 25/0626* (2013.01); *F04D 29/083* (2013.01)

(58) Field of Classification Search
CPC ..... F16C 17/02; F16C 17/10; F16C 17/107; F16C 33/745; F04D 25/0062; F04D 29/056; F04D 29/057; F04D 29/063; F04D 25/064
(Continued)

(56) References Cited

U.S. PATENT DOCUMENTS

| | | | |
|---|---|---|---|
| 5,441,386 | A | 8/1995 | Hsieh |
| 5,984,525 | A | 11/1999 | Ikeda et al. |

(Continued)

FOREIGN PATENT DOCUMENTS

| | | | |
|---|---|---|---|
| JP | 6-031199 | Y2 | 10/1990 |
| JP | 2007-282374 | A | 10/2007 |

*Primary Examiner* — James Pilkington
(74) *Attorney, Agent, or Firm* — Westerman, Hattori, Daniels & Adrian, LLP

(57) ABSTRACT

There is provided a blower fan including a motor. In its bearing apparatus, the inner circumferential surface of the rotor cylindrical portion 222*b* and the outer circumferential surface of the bearing portion are arranged to together define a seal gap 35. The bushing 26 includes a bushing base portion 260 and a bushing cylindrical portion 262. The inner circumferential surface of the bushing cylindrical portion 262 and the outer circumferential surface of the rotor cylindrical portion 222*b* are arranged to together define a vertical gap. The vertical gap is arranged to have a minimum radial width equal to or smaller than a maximum width of the seal gap. A lower end portion of the rotor raised portion 514 and an upper end portion of the bushing cylindrical portion 262 are arranged to together define a second horizontal gap 266*a*.

12 Claims, 13 Drawing Sheets

(51) Int. Cl.
*F04D 17/16* (2006.01)
*F04D 29/08* (2006.01)

(58) Field of Classification Search
USPC ..... 384/100, 107, 112, 114, 120, 121, 123
See application file for complete search history.

(56) References Cited

U.S. PATENT DOCUMENTS

| | | | |
|---|---|---|---|
| 6,010,318 | A | 1/2000 | Li |
| 6,024,496 | A | 2/2000 | Shy |
| 6,412,984 | B2 | 7/2002 | Asai et al. |
| 6,692,152 | B2 | 2/2004 | Shingai et al. |
| 6,756,714 | B2 | 6/2004 | Alex et al. |
| 6,832,853 | B2 | 12/2004 | Fujinaka |
| 6,843,602 | B2 | 1/2005 | Koseki et al. |
| 7,052,254 | B2 | 5/2006 | Lin |
| 7,296,801 | B2 | 11/2007 | Chen |
| 7,364,400 | B2 | 4/2008 | Ku et al. |
| 7,478,951 | B2 | 1/2009 | Uenosono |
| 7,567,003 | B2 | 7/2009 | Hong et al. |
| 7,654,796 | B2 | 2/2010 | Yeh et al. |
| 7,798,721 | B2 | 9/2010 | Shibahara et al. |
| 8,057,172 | B2 | 11/2011 | Li |
| 8,142,136 | B2 | 3/2012 | Li |
| 8,562,218 | B2 | 10/2013 | Kull |
| 2002/0061149 | A1 | 5/2002 | Shingai et al. |
| 2004/0145260 | A1 | 7/2004 | Tamaoka et al. |
| 2004/0239198 | A1 | 12/2004 | Horng et al. |
| 2005/0135003 | A1 | 6/2005 | Inoue et al. |
| 2006/0255668 | A1 | 11/2006 | Chen et al. |
| 2007/0183699 | A1 | 8/2007 | Shishido |
| 2007/0188034 | A1 | 8/2007 | Yoshida |
| 2007/0212219 | A1 | 9/2007 | Teshima et al. |
| 2007/0222314 | A1 | 9/2007 | Drautz |
| 2007/0223848 | A1 | 9/2007 | Winterhalter |
| 2007/0236091 | A1 | 10/2007 | Fukushima |
| 2007/0267928 | A1 | 11/2007 | Yeh et al. |
| 2009/0001825 | A1 | 1/2009 | Hanaoka et al. |
| 2009/0022438 | A1 | 1/2009 | Tamaoka |
| 2009/0053063 | A1 | 2/2009 | Liang et al. |
| 2009/0279817 | A1* | 11/2009 | Shimizu ..... F16C 17/107 384/107 |
| 2010/0244601 | A1 | 9/2010 | Shimizu et al. |
| 2011/0026163 | A1* | 2/2011 | Komori ..... G11B 19/2036 360/234.1 |
| 2011/0200279 | A1 | 8/2011 | Goto |
| 2012/0057966 | A1 | 3/2012 | Chen et al. |

* cited by examiner

BLOWER FAN

CROSS-REFERENCE TO RELATED APPLICATION

This application is a continuation of U.S. application Ser. No. 13/482,754, filed on May 29, 2012, which claims the benefit of priority from the prior Japanese Patent Application No. 2011-146730, filed on Jun. 30, 2011, Japanese Patent Application No. 2011-242502, filed on Nov. 4, 2011 and Japanese Patent Application No. 2012-060726, filed on Mar. 16, 2012, the entire contents of which are incorporated herein by reference.

BACKGROUND OF THE INVENTION

1. Field of the Invention

The present invention relates to a bearing apparatus. In particular, the present invention relates to a bearing apparatus installed in a blower fan.

2. Description of the Related Art

In recent years, electronic devices have been becoming more and more densely packed with components, and electronic components installed in the electronic devices and blower fans arranged to cool the electronic components have accordingly tended to be disposed close to each other. Such a blower fan is arranged to produce air currents through rotation of an impeller, i.e., a rotating body. In addition, the amount of heat generated in the electronic devices has been increasing year after year, and there has been a demand for an increase in rotation speed of the blower fans. However, the increase in the rotation speed of the blower fans leads to an increase in a peak value of vibration in each frequency, and then vibrations may exert harmful effects on the electronic components.

Therefore, in order to reduce vibrations which accompany the rotation of the blower fan, it is necessary to reduce oscillation of an axis of a rotating body of the blower fan. One specific method of achieving this is to adopt a fluid dynamic bearing as a bearing portion to support a circumference of a shaft through a lubricating oil so that vibrations generated in the rotating body can be attenuated. In addition, use of a thrust bearing will contribute to preventing tilting of the shaft. A bearing as described above is disclosed in JP-UM-B 06-31199.

SUMMARY OF THE INVENTION

In a brushless fan motor of a type illustrated in JP-UM-B 06-31199, a sleeve is fixed in a central hole of an inner tubular portion of a case, and a stator is arranged on an outer circumference of the inner tubular portion. In addition, an annular member is fixed to a lower end portion of a shaft. A thrust bearing is defined between a lower end surface of the sleeve and the annular member. A radial dynamic pressure bearing is defined between the shaft and the sleeve on an upper side of the thrust bearing. The fan motor described in JP-UM-B 06-31199 has a problem in that dust can easily enter into a gap defined between the sleeve and a combination of the shaft and the annular member through upper and lower opening ends of the gap.

In addition, a fluid dynamic bearing described in JP-UM-B 06-31199 has a problem in that it is difficult to maintain a high precision in axial position of the annular member fixed to the shaft, which may permit the shaft to easily wobble.

There is also a demand for a decrease in the outside diameter of the shaft of the motor in order to reduce a shaft loss through the bearing. Further, there is a demand for an increase in the diameter of the stator in order to obtain a high torque of the motor. In order to achieve both the reduction in the shaft loss and the high torque described above, it is necessary to arrange a bushing between the bearing portion and the stator. When the bushing is used, it is necessary to improve strength with which the bushing and a mounting plate are fixed to each other, and also to increase precision in positioning each of the stator and the mounting plate with respect to the bushing.

A primary advantage of the present invention is to reduce the likelihood of entry of dust into a bearing apparatus.

A blower fan comprising a motor; an impeller caused by the motor to rotate about a central axis; and a housing arranged to contain the motor and the impeller; wherein the motor includes: a stationary portion; a bearing apparatus; and a rotating portion supported by the bearing apparatus to be rotatable with respect to the stationary portion; the rotating portion includes a rotor holder including a first holder member and a second holder member including an outer circumferential surface to which the impeller is fixed; the first holder member includes: a first thrust portion; and a rotor cylindrical portion arranged to extend downward from an outer edge portion of the first thrust portion; the second holder member includes a cover portion including, in an inner edge portion thereof, a cover portion cylindrical portion arranged to extend downward; the rotor cylindrical portion includes an annular rotor raised portion arranged to project radially outward from an outer circumferential surface thereof; the second holder member is attached to the first holder member; and a lower end portion of the cover portion cylindrical portion is arranged to be in axial contact with the rotor raised portion.

In accordance with the present invention, it is possible to reduce the likelihood that dust will enter into a bearing apparatus.

DETAILED DESCRIPTION OF THE PREFERRED EMBODIMENTS

Figure 1:
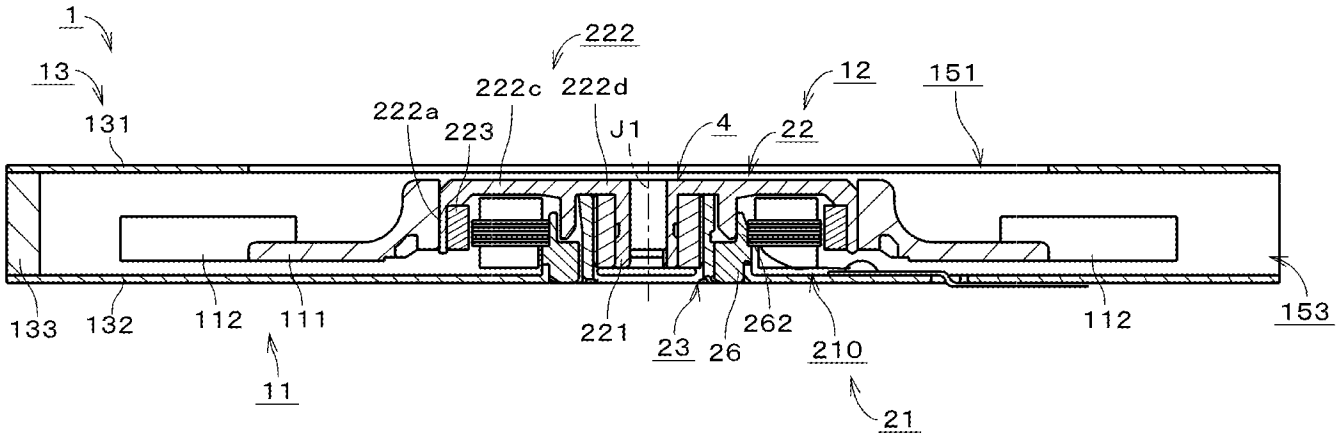
FIG. 1 is a cross-sectional view of a blower fan according to a first preferred embodiment of the present invention.

It is assumed herein that a vertical direction is defined as a direction in which a central axis of a motor extends, and that an upper side and a lower side along the central axis in FIG. 1 are referred to simply as an upper side and a lower side, respectively. It should be noted, however, that the above definitions of the vertical direction and the upper and lower sides should not be construed to restrict relative positions or directions of different members or portions when the motor is actually installed in a device. Also note that a direction parallel to the central axis is referred to by the term "axial direction", "axial", or "axially", that radial directions centered on the central axis are simply referred to by the term "radial direction", "radial", or "radially", and that a circumferential direction about the central axis is simply referred to by the term "circumferential direction", "circumferential", or "circumferentially".

First Preferred Embodiment

FIG. 1 is a cross-sectional view of a blower fan 1 according to a first preferred embodiment of the present invention. The blower fan 1 is a centrifugal fan, and is, for example, used to cool electronic components inside a notebook personal computer. The blower fan 1 includes an impeller 11, a motor 12, and a housing 13. The impeller 11 is arranged to extend radially outward from a rotating portion 22 of the motor 12. The impeller 11 is arranged to rotate about a central axis J1 through the motor 12.

The impeller 11 is made of a resin, and includes a substantially cylindrical cup 111 and a plurality of blades 112. An inner circumferential surface of the cup 111 is fixed to the rotating portion 22 of the motor 12. The blades 112 are arranged to extend radially outward from an outer circumferential surface of the cup 111 with the central axis J1 as a center. The cup 111 and the blades 112 are produced as a single continuous member by a resin injection molding process.

The blower fan 1 is arranged to produce air currents through rotation of the impeller 11 about the central axis J1 caused by the motor 12.

The housing 13 is arranged to contain the motor 12 and the impeller 11. The housing 13 includes an upper plate portion 131, a mounting plate 132 (hereinafter referred to as a lower plate portion 132), and a side wall portion 133. The upper plate portion 131 is a substantially plate-shaped member made of a metal. The upper plate portion 131 is arranged on an upper side of the motor 12 and the impeller 11. The upper plate portion 131 includes one air inlet 151 extending therethrough in the vertical direction. The air inlet 151 is arranged to overlap with the impeller 11 and the motor 12 in an axial direction. The air inlet 151 is arranged substantially in the shape of a circle, and is arranged to overlap with the central axis J1.

The lower plate portion 132 is a substantially plate-shaped member produced by subjecting a metal sheet to press working. The lower plate portion 132 is arranged on a lower side of the motor 12 and the impeller 11. The lower plate portion 132 defines a portion of a stationary portion 21 of the motor 12. The side wall portion 133 is made of a resin. The side wall portion 133 is arranged to cover sides of the impeller 11. That is, the side wall portion 133 is arranged radially outside the blades 112 to surround the blades 112. The upper plate portion 131 is fixed to an upper end portion of the side wall portion 133 through screws or by another fixing method. A lower end portion of the side wall portion 133 is joined to the lower plate portion 132 through insert molding. The side wall portion 133 is arranged substantially in the shape of the letter "U" when viewed in a direction parallel to the central axis J1, and includes an air outlet 153 which opens radially outward. In more detail, portions of the upper and lower plate portions 131 and 132 are arranged on an upper side and a lower side, respectively, of an opening of the side wall portion 133, and an area enclosed by the upper and lower plate portions 131 and 132 and the opening of the side wall portion 133 is the air outlet 153. Note that the side wall portion 133 may not necessarily be joined to the lower plate portion 132 through insert molding. Also note that the side wall portion 133 may not necessarily be made of a resin. Also note that each of the upper and lower plate portions 131 and 132 may be fixed to the side wall portion 133 by a fixing method not mentioned above.

Figure 2:
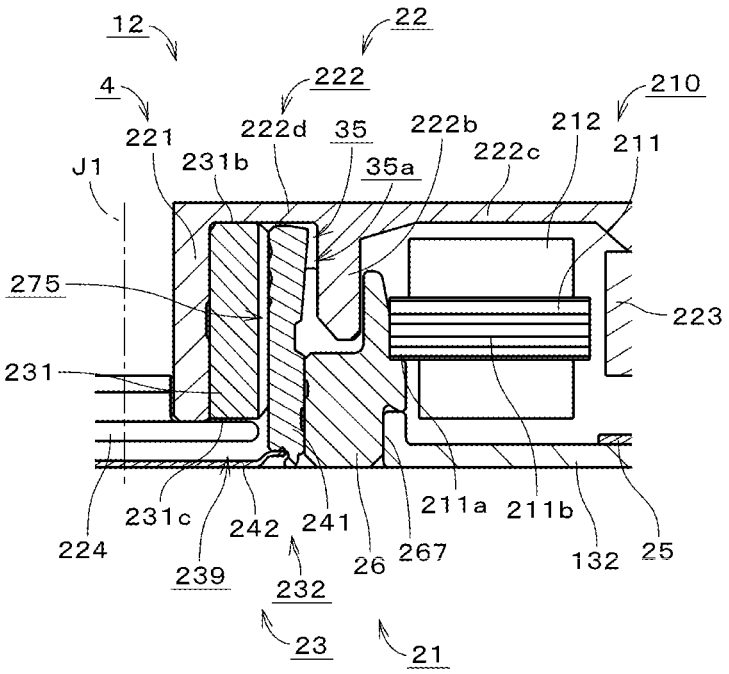
FIG. 2 is a cross-sectional view of a motor and its vicinity according to the first preferred embodiment.

FIG. 2 is a cross-sectional view of the motor 12 and its vicinity. The motor 12 is an outer-rotor motor. The motor 12 includes the stationary portion 21 and the rotating portion 22. Since a bearing mechanism 4 is defined by a portion of the stationary portion 21 and a portion of the rotating portion 22 as described below, the motor 12 can be considered to include the stationary portion 21, the bearing mechanism 4, and the rotating portion 22 when the bearing mechanism 4 is regarded as a component of the motor 12. The stationary portion 21 includes a bearing portion 23, the lower plate portion 132, a stator 210, a circuit board 25, and a bushing 26.

The bearing portion 23 is arranged radially inward of the stator 210. The bearing portion 23 includes a sleeve 231 and a bearing housing 232. The bearing portion 23 is arranged substantially in the shape of a cylinder with a bottom. The sleeve 231 is substantially cylindrical in shape and centered on the central axis J1. The sleeve 231 is a metallic sintered body. The sleeve 231 is impregnated with a lubricating oil. A plurality of circulation grooves 275, each of which is arranged to extend in the axial direction and is used for pressure regulation, are defined in an outer circumferential surface of the sleeve 231. The circulation grooves 275 are arranged at regular intervals in a circumferential direction. The bearing housing 232 is arranged substantially in the shape of a cylinder with a bottom, and includes a housing cylindrical portion 241 and a cap 242. The housing cylindrical portion 241 is substantially cylindrical in shape and centered on the central axis J1, and is arranged to cover the outer circumferential surface of the sleeve 231. The sleeve 231 is fixed to an inner circumferential surface of the housing cylindrical portion 241 through an adhesive. The bearing housing 232 is made of a metal. The cap 242 is fixed to a lower end portion of the housing cylindrical portion 241. The cap 242 is arranged to close a bottom portion of the housing cylindrical portion 241. Note that use of the adhesive to fix the sleeve 231 to the inner circumferential surface of the housing cylindrical portion 241 is not essential to the present invention. For example, the sleeve 231 may be fixed to the inner circumferential surface of the housing cylindrical portion 241 through press fit.

The bushing 26 is a substantially annular member. The bushing 26 is produced by subjecting a metallic member to a cutting process. An inner circumferential surface of the bushing 26 is fixed to a lower portion of an outer circumferential surface of the housing cylindrical portion 241, i.e., a lower portion of an outer circumferential surface of the bearing housing 232, through adhesion or press fit. Note that both adhesion and press fit may be used. Meanwhile, an outer circumferential surface of the bushing 26 is fixed to a hole portion of the lower plate portion 132. That is, the outer circumferential surface of the bushing 26 defines an attachment surface 267 to which the lower plate portion 132, which is arranged to support the bearing portion 23, is directly attached.

The stator 210 is a substantially annular member centered on the central axis J1. The stator 210 includes a stator core 211 and a plurality of coils 212 arranged on the stator core 211. The stator core 211 is defined by laminated silicon steel sheets, each of which is in the shape of a thin sheet. The stator core 211 includes a substantially annular core back 211*a* and a plurality of teeth 211*b* arranged to project radially outward from the core back 211*a*. A conducting wire is wound around each of the teeth 211*b* to define the coils 212. The circuit board 25 is arranged below the stator 210. Lead wires of the coils 212 are electrically connected to the circuit board 25. The circuit board 25 is a flexible printed circuit (FPC) board.

The rotating portion 22 includes a shaft 221, a rotor holder 222, a rotor magnet 223, and a thrust plate 224. The shaft 221 is arranged to have the central axis J1 as a center thereof.

Referring to FIG. 1, the rotor holder 222 is arranged substantially in the shape of a covered cylinder and centered on the central axis J1. The rotor holder 222 includes a tubular "magnet holding cylindrical portion" 222*a*, a cover portion 222*c*, and a first thrust portion 222*d*. The magnet holding cylindrical portion 222*a*, the cover portion 222*c*, and the first thrust portion 222*d* are defined integrally with one another. The first thrust portion 222*d*, which corresponds to an upper thrust portion, is arranged to extend radially outward from an upper end portion of the shaft 221. The cover portion 222*c* is arranged to extend radially outward from the first thrust portion 222*d*. The upper plate portion 131 is arranged above the cover portion 222*c* and the first thrust portion 222*d*. A lower surface of the cover portion 222*c* is arranged axially opposite an upper surface of the stator 210. Referring to FIG. 2, a lower surface of the first thrust portion 222*d* is arranged axially opposite each of an upper surface 231*b* of the sleeve 231 and an upper surface of the housing cylindrical portion 241.

The thrust plate 224, which corresponds to a lower thrust portion, includes a substantially disk-shaped portion arranged to extend radially outward. The thrust plate 224 is fixed to a lower end portion of the shaft 221, and is arranged to extend radially outward from the lower end portion thereof. The thrust plate 224 is accommodated in a plate accommodating portion 239 defined by a lower surface 231*c* of the sleeve 231, an upper surface of the cap 242, and a lower portion of the inner circumferential surface of the housing cylindrical portion 241. An upper surface of the thrust plate 224 is a substantially annular surface arranged around the shaft 221. The upper surface of the thrust plate 224 is arranged axially opposite the lower surface 231*c* of the sleeve 231, i.e., a downward facing surface in the plate accommodating portion 239. Hereinafter, the thrust plate 224 will be referred to as a "second thrust portion 224". A lower surface of the second thrust portion 224 is arranged opposite to the upper surface of the cap 242 of the bearing housing 232. The shaft 221 is inserted in the sleeve 231. Note that the second thrust portion 224 may be defined integrally with the shaft 221.

The shaft 221 is defined integrally with the rotor holder 222. The shaft 221 and the rotor holder 222 are produced by subjecting a metallic member to a cutting process. That is, the cover portion 222*c* and the shaft 221 are continuous with each other. Note that the shaft 221 may be defined by a member separate from the rotor holder 222. In this case, the upper end portion of the shaft 221 is fixed to the cover portion 222*c* of the rotor holder 222. Referring to FIG. 1, the rotor magnet 223 is fixed to an inner circumferential surface of the magnet holding cylindrical portion 222*a*, which is arranged to extend axially downward from a radially outer end portion of the cover portion 222*c* of the rotor holder 222.

Referring to FIG. 2, the rotor holder 222 further includes a substantially annular "rotor cylindrical portion" 222*b* arranged to extend downward from an outer edge portion of the first thrust portion 222*d*. The rotor cylindrical portion 222*b* of the rotor holder 222 is arranged radially inward of the stator 210. The rotor cylindrical portion 222*b* is arranged radially outward of the bearing housing 232. An inner circumferential surface of the rotor cylindrical portion 222*b* is arranged radially opposite an outer circumferential surface of an upper portion of the housing cylindrical portion 241. A seal gap 35 is defined between the inner circumferential surface of the rotor cylindrical portion 222*b* and the outer circumferential surface of the housing cylindrical portion 241. A seal portion 35*a* having a surface of the lubricating oil defined therein is defined in the seal gap 35.

Referring to FIG. 1, the inner circumferential surface of the cup 111 is fixed to an outer circumferential surface of the magnet holding cylindrical portion 222*a* of the rotor holder 222. The upper end portion of the shaft 221 is fixed to the impeller 11 through the rotor holder 222. Note that the impeller 11 may be defined integrally with the rotor holder 222. In this case, the upper end portion of the shaft 221 is fixed to the impeller 11 in a direct manner.

The rotor magnet 223 is substantially cylindrical in shape and centered on the central axis J1. As described above, the rotor magnet 223 is fixed to the inner circumferential surface of the magnet holding cylindrical portion 222*a*. The rotor magnet 223 is arranged radially outward of the stator 210.

Figure 3:
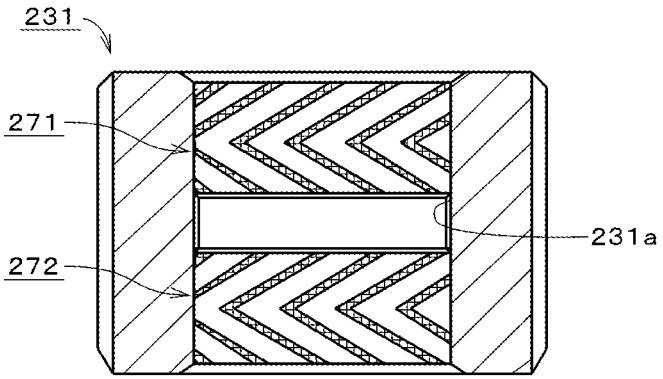
FIG. 3 is a cross-sectional view of a sleeve according to the first preferred embodiment.
Figure 4:
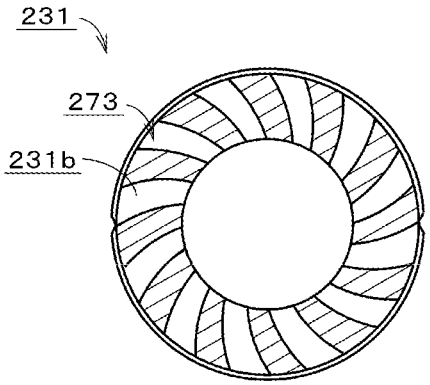
FIG. 4 is a plan view of the sleeve.
Figure 5:
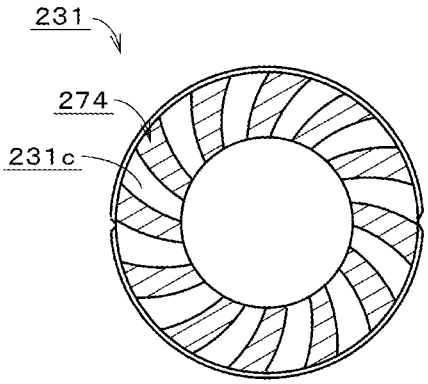
FIG. 5 is a bottom view of the sleeve.

FIG. 3 is a cross-sectional view of the sleeve 231. A first radial dynamic pressure groove array 271 and a second radial dynamic pressure groove array 272 are defined in an upper portion and a lower portion, respectively, of an inner circumferential surface 231*a* of the sleeve 231. Each of the first and second radial dynamic pressure groove arrays 271 and 272 is made up of a plurality of grooves arranged in a herringbone pattern. FIG. 4 is a plan view of the sleeve 231. A first thrust dynamic pressure groove array 273 is defined in the upper surface 231*b* of the sleeve 231. The first thrust dynamic pressure groove array 273 is made up of a plurality of grooves arranged in a spiral pattern. FIG. 5 is a bottom view of the sleeve 231. A second thrust dynamic pressure groove array 274 is defined in the lower surface 231*c* of the sleeve 231. The second thrust dynamic pressure groove array 274 is made up of a plurality of grooves arranged in the spiral pattern.

Figure 6:
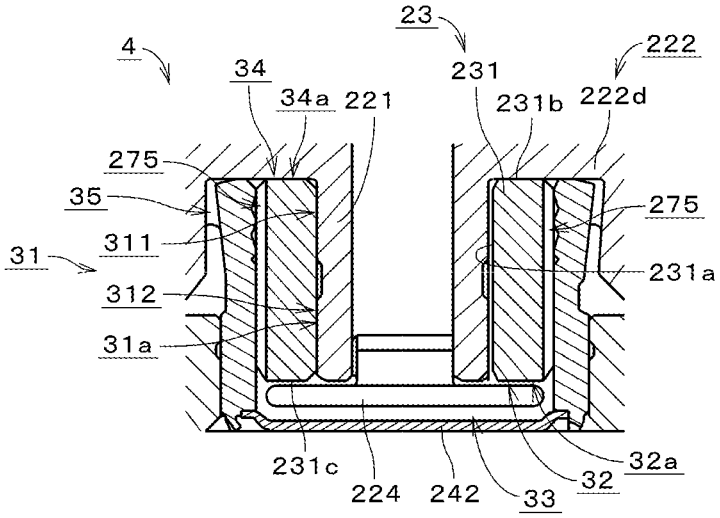
FIG. 6 is a cross-sectional view of a bearing portion and its vicinity according to the first preferred embodiment.

FIG. 6 is a cross-sectional view of the bearing portion 23 and its vicinity. A radial gap 31 is defined between an outer circumferential surface of the shaft 221 and the inner circumferential surface 231*a* of the sleeve 231. The radial gap 31 includes a first radial gap 311 and a second radial gap 312, which is arranged on a lower side of the first radial gap 311. The first radial gap 311 is defined between the outer circumferential surface of the shaft 221 and a portion of the inner circumferential surface 231*a* of the sleeve 231 in which the first radial dynamic pressure groove array 271 illustrated in FIG. 3 is defined. The lubricating oil is arranged in the first radial gap 311. The second radial gap 312 is defined between the outer circumferential surface of the shaft 221 and a portion of the inner circumferential surface 231*a* of the sleeve 231 in which the second radial dynamic pressure groove array 272 illustrated in FIG. 3 is defined. The lubricating oil is arranged in the second radial gap 312. The first and second radial gaps 311 and 312 are arranged to together define a radial dynamic pressure bearing portion 31*a* arranged to produce a fluid dynamic pressure in the lubricating oil. The shaft 221 is supported in a radial direction by the radial dynamic pressure bearing portion 31*a*.

A first thrust gap 34 is defined between a portion of the upper surface 231*b* of the sleeve 231 in which the first thrust dynamic pressure groove array 273 is defined and the lower surface of the first thrust portion 222*d*, i.e., the upper thrust portion. The lubricating oil is arranged in the first thrust gap 34. The first thrust gap 34 is arranged to define an upper thrust dynamic pressure bearing portion 34*a* arranged to produce a fluid dynamic pressure in the lubricating oil. The first thrust portion 222*d* is supported in the axial direction by the upper thrust dynamic pressure bearing portion 34*a*.

A second thrust gap 32 is defined between a portion of the lower surface 231*c* of the sleeve 231 in which the second thrust dynamic pressure groove array 274 is defined and the upper surface of the second thrust portion 224, i.e., the lower thrust portion. The lubricating oil is arranged in the second thrust gap 32. The second thrust gap 32 is arranged to define a lower thrust dynamic pressure bearing portion 32*a* arranged to produce a fluid dynamic pressure in the lubricating oil. The second thrust portion 224 is supported in the axial direction by the lower thrust dynamic pressure bearing portion 32*a*. Provision of the upper and lower thrust dynamic pressure bearing portions 34*a* and 32*a* contributes to reducing wobbling of the shaft 221. The upper and lower thrust dynamic pressure bearing portions 34*a* and 32*a* are arranged to be in communication with each other through the circulation grooves 275.

A third thrust gap 33 is defined between the upper surface of the cap 242 of the bearing housing 232 and the lower surface of the second thrust portion 224.

In the motor 12, the seal gap 35, the first thrust gap 34, the radial gap 31, the second thrust gap 32, and the third thrust gap 33 are arranged to together define a single continuous bladder structure, and the lubricating oil is arranged continuously in this bladder structure. Within the bladder structure, a surface of the lubricating oil is defined only in the seal gap 35. The bladder structure contributes to easily preventing a leakage of the lubricating oil.

Referring to FIG. 2, in the motor 12, the shaft 221, the first thrust portion 222*d*, the rotor cylindrical portion 222*b*, which is arranged to extend downward from the outer edge portion of the first thrust portion 222*d*, the second thrust portion 224, the bearing portion 23, the bushing 26, and the lubricating oil are arranged to together define the bearing mechanism 4, which is a bearing apparatus. Hereinafter, each of the shaft 221, the first thrust portion 222*d*, the rotor cylindrical portion 222*b*, the second thrust portion 224, the bearing portion 23, and the bushing 26 will be referred to as a portion of the bearing mechanism 4. In the bearing mechanism 4, the shaft 221, the first thrust portion 222*d*, and the second thrust portion 224 are arranged to rotate about the central axis J1 relative to the bearing portion 23 with the lubricating oil intervening therebetween.

In the motor 12, once power is supplied to the stator 210, a torque centered on the central axis J1 is produced between the rotor magnet 223 and the stator 210. The rotating portion 22 and the impeller 11 are supported through the bearing mechanism 4 illustrated in FIG. 1 such that the rotating portion 22 and the impeller 11 are rotatable about the central axis J1 with respect to the stationary portion 21. The rotation of the impeller 11 causes an air to be drawn into the housing 13 through the air inlet 151 and then sent out through the air outlet 153.

Figure 7:
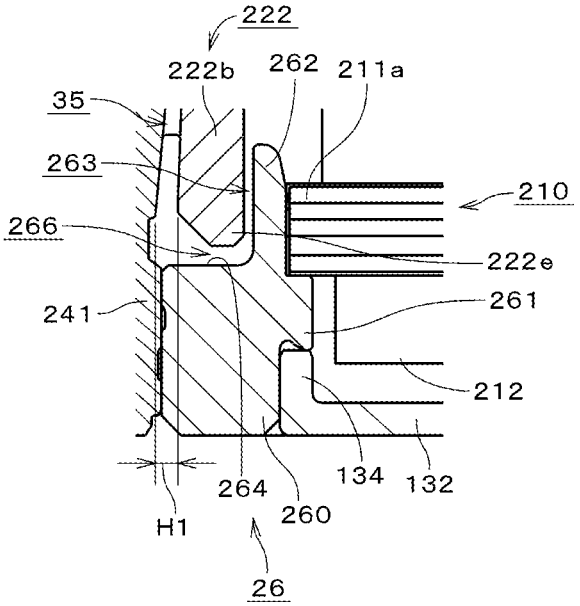
FIG. 7 is a cross-sectional view of a bushing and its vicinity according to the first preferred embodiment.

FIG. 7 is a cross-sectional view of the bushing 26 and its vicinity. The inner circumferential surface of the bushing 26 is fixed to the lower portion of the outer circumferential surface of the housing cylindrical portion 241. That is, the bushing 26 is fixed to the lower portion of the outer circumferential surface of the housing cylindrical portion 241 through press fit. Note that the bushing 26 may be fixed to the housing cylindrical portion 241 by another fixing method than press fit or by a combination of press fit and another fixing method. The bushing 26 includes a raised portion 261 arranged to project radially outward from the outer circumferential surface thereof. The raised portion 261 is arranged in an annular shape, extending continuously in the circumferential direction. That is, the raised portion 261 is defined by a single continuous portion. Thus, the cutting process for the bushing 26 can be easily accomplished when the raised portion 261 is arranged in the continuous annular shape.

The bushing 26 further includes a substantially cylindrical "bushing cylindrical portion" 262 arranged to extend upward on an upper side of the raised portion 261. Hereinafter, an entire portion of the bushing 26 except for the bushing cylindrical portion 262 will be referred to as a "bushing base portion 260". The bushing base portion 260 is arranged to extend radially outward from an outer circumferential surface of the bearing portion 23. The bushing cylindrical portion 262 is arranged to extend upward continuously from the bushing base portion 260. The stator 210 is fixed to an outer circumferential surface of the bushing cylindrical portion 262. That is, an inner circumferential surface of the core back 211*a* of the stator 210 is fixed to the bushing 26 on the upper side of the raised portion 261. A lower end of each coil 212 is arranged at a level lower than that of a lower surface of the raised portion 261.

A lower end of the core back 211*a* is arranged to be in axial contact with an upper surface of the raised portion 261 of the bushing 26. Positioning of the stator 210 with respect to the bushing 26 can thus be accomplished easily. Note that the raised portion 261 and the core back 221*a* may be arranged to be out of contact with each other.

An inner circumferential surface of the bushing cylindrical portion 262 is arranged radially opposite an outer circumferential surface of the rotor cylindrical portion 222*b*. The bushing cylindrical portion 262 is a radially opposing portion arranged opposite to the outer circumferential surface of the rotor cylindrical portion 222*b*. A minute vertical gap 263 extending in the axial direction is defined between the inner circumferential surface of the bushing cylindrical portion 262 and the outer circumferential surface of the rotor cylindrical portion 222*b*. Provision of the vertical gap 263 contributes to preventing an air including a lubricating oil evaporated from the seal gap 35 from traveling out of the bearing portion 23. This contributes to reducing evaporation of the lubricating oil out of the bearing portion 23. In other words, the vertical gap 263 is arranged to define a labyrinth structure. Because each of the rotor holder 222 and the bushing 26, which together define the vertical gap 263, is produced by subjecting the metallic member to the cutting process, it is possible to define a labyrinth gap therebetween with high precision.

The bushing 26 includes an annular surface 264 centered on the central axis J1, arranged to be substantially perpendicular to the central axis J1, and arranged radially inward of the bushing cylindrical portion 262. The annular surface 264 is an upper surface of the bushing base portion 260, and is arranged axially opposite a lower end portion 222*e* of the rotor cylindrical portion 222*b*. The bushing base portion 260 is an axially opposing portion arranged axially opposite the lower end portion 222*e* of the rotor cylindrical portion 222*b*. A horizontal gap 266 extending in the radial direction is defined between the bushing base portion 260 and the lower end portion 222*e* of the rotor cylindrical portion 222*b*. The horizontal gap 266 is also arranged to define a labyrinth structure. The vertical gap 263 and the horizontal gap 266 are arranged to together define a complicated labyrinth structure.

The annular surface 264 is arranged to cover the seal gap 35. The axial distance between the annular surface 264 and the lower end portion 222*e* of the rotor cylindrical portion 222*b*, that is, a minimum axial width of the horizontal gap 266, is preferably arranged to be smaller than a maximum width H1 of the seal gap 35. The maximum width of the seal gap 35 refers to a maximum width of a region thereof which is usable to hold the lubricating oil therein. Similarly, a minimum radial width of the vertical gap 263 is preferably arranged to be smaller than the maximum width of the seal gap 35. Thus, the bushing 26 is a seal cover arranged to cover the seal gap 35.

The lower plate portion 132 includes a lower plate cylindrical portion 134 arranged substantially in the shape of a cylinder and centered on the central axis J1. The lower plate cylindrical portion 134 is fixed to a portion of the outer circumferential surface of the bushing 26 which is below the raised portion 261 through press fit. That is, the bushing 26 is press fitted to the lower plate cylindrical portion 134. The bushing 26 is securely fixed to the lower plate cylindrical portion 134 due to the bushing 26 being fixed to the lower plate cylindrical portion 134 through press fit. In other words, the housing cylindrical portion 241 is securely fixed to the lower plate portion 132 through intervention of the bushing 26.

In addition, the lower plate cylindrical portion 134 is fixed to the bushing 26 on a lower side of the raised portion 261. Therefore, an inner circumferential surface of the lower plate cylindrical portion 134 is arranged radially inward of a radially outer end of the raised portion 261. Thus, a reduction in the radial dimension of a portion of the lower plate cylindrical portion 134 which projects radially outward from the radially outer end of the raised portion 261 is achieved. Moreover, an upper end of the lower plate cylindrical portion 134 is arranged to be in axial contact with the lower surface of the raised portion 261. This contributes to improving precision with which each of the stator 210 and the lower plate portion 132 is positioned with respect to the bushing 26. Note that the lower plate cylindrical portion 134 and the raised portion 261 may be arranged to be out of contact with each other.

A portion of the outer circumferential surface of the bushing 26 to which the lower plate cylindrical portion 134 is fixed is arranged radially inward of a portion of the outer circumferential surface of the bushing cylindrical portion 262 to which the core back 211*a* is fixed.

An outer circumferential surface of the raised portion 261 of the bushing 26 is arranged to coincide with an outer circumferential surface of the lower plate cylindrical portion 134 in the radial direction, or arranged radially outward of the outer circumferential surface of the lower plate cylindrical portion 134. This contributes to preventing any coil 212 from coming into contact with the lower plate cylindrical portion 134 even in the case where the lower end of each coil 212 is arranged at a level lower than that of the lower surface of the raised portion 261. This contributes to reducing the height of the motor 12, or increasing a space factor of the coils 212. Moreover, prevention of the contact between each coil 212 and the lower plate cylindrical portion 134 contributes to preventing a break in the conducting wire of the coil 212.

As described above, the bearing portion 23 can be made up of component units and securely fixed to the lower plate portion 132 through the intervention of the bushing 26.

Next, a procedure of manufacturing the blower fan 1 will now be described below. First, the bearing portion 23 is prepared with the shaft 221 integrally defined with the rotor holder 222 illustrated in FIG. 1 arranged inside the bearing portion 23.

Next, the rotor magnet 223 is fixed to the inner circumferential surface of the magnet holding cylindrical portion 222*a* of the rotor holder 222. The impeller 11 is fixed to the outer circumferential surface of the magnet holding cylindrical portion 222*a* of the rotor holder 222.

Next, the stator 210 is fixed to the outer circumferential surface of the bushing cylindrical portion 262 of the bushing 26. After the stator 210 is fixed to the bushing 26, the bearing portion 23 is fixed to the inner circumferential surface of the bushing 26.

Thereafter, a weight is arranged on a lower end portion of the cup 111 or its vicinity. The weight is an adhesive containing a metal having a high specific gravity, such as tungsten or the like. Note that the weight may be arranged on the lower end portion of the cup 111 or its vicinity before the rotor magnet 223 is fixed to the inner circumferential surface of the magnet holding cylindrical portion 222*a* of the rotor holder 222, or before the impeller 11 is fixed to the outer circumferential surface of the magnet holding cylindrical portion 222*a* of the rotor holder 222. A reduction in unbalance of the impeller 11 and the rotating portion 22 of the motor 12 can be achieved by arranging the weight on the lower end portion of the cup 111 of the impeller 11 or its vicinity. The reduction in the unbalance contributes to reducing vibrations of the blower fan 1 owing to displacement of a center of gravity of the impeller 11 and the motor 12 from the central axis J1.

After the aforementioned balance correction, the lower plate portion 132 is fixed to the bushing 26 from below the bushing 26, so that manufacture of the bearing mechanism 4 of the blower fan 1 is completed.

The labyrinth structure is defined by covering the seal gap 35 with the bushing 26. As a result, the likelihood that dust will enter into the bearing mechanism 4 is reduced. The labyrinth structure is further complicated by arranging the vertical gap 263 radially outward of the seal gap 35. This contributes to more securely preventing dust from entering into the bearing mechanism 4. This contributes to preventing a deterioration in bearing performance of the bearing mechanism 4. As described above, provision of the labyrinth structure makes it possible to securely fix the bearing portion 23 to the lower plate portion 132 through the intervention of the bushing 26 even when a so-called bearing unit, in which the shaft 221 is arranged inside the bearing portion 23, is constructed.

In the case of a blower fan which allows the lower plate portion to be attached to the bushing only from above the bushing, fixing of the bushing to the bearing housing needs to be performed after the lower plate portion is attached to the bushing. In contrast, in the case of the blower fan 1, it is possible to attach the lower plate portion 132 to the bushing 26 from below the bushing 26 after the bearing mechanism 4 is assembled. Thus, an improvement in flexibility in assembling the blower fan 1 is achieved.

Figure 8:
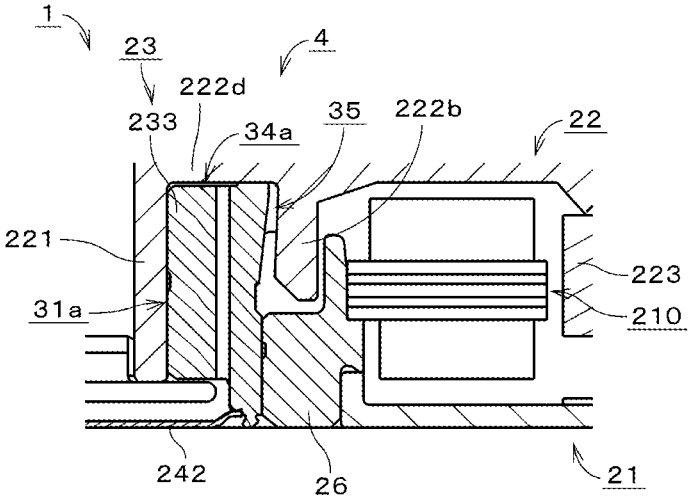
FIG. 8 is a cross-sectional view of a motor and its vicinity according to a modification of the first preferred embodiment.

FIG. 8 is a diagram illustrating a bearing mechanism 4 according to a modification of the first preferred embodiment. A bearing portion 23 includes a cylindrical sleeve 233 arranged radially outside a shaft 221 to surround the shaft 221, and a cap 242 arranged to close a bottom portion of the sleeve 233. The bearing portion 23 is arranged substantially in the shape of a cylinder with a bottom. The sleeve 233 is produced, for example, by subjecting a metallic member made of stainless steel or the like to a cutting process. The cap 242 is directly fixed to the sleeve 233. A rotor cylindrical portion 222*b* is arranged to extend downward, radially outside of the sleeve 233. A seal gap 35 is defined between an upper portion of an outer circumferential surface of the sleeve 233 and an inner circumferential surface of the rotor cylindrical portion 222*b*. The seal gap 35 has a surface of a lubricating oil defined therein. A lower portion of the outer circumferential surface of the sleeve 233 is fixed to a bushing 26.

In the bearing mechanism 4, a radial gap is defined between an inner circumferential surface of the sleeve 233 and an outer circumferential surface of the shaft 221, and a radial dynamic pressure bearing portion 31*a* arranged to support the shaft 221 in the radial direction is defined in the radial gap. In addition, a thrust gap is defined between an upper surface of the sleeve 233 and a lower surface of a first thrust portion 222*d*. An upper thrust dynamic pressure bearing portion 34*a* is defined in the thrust gap. No thrust dynamic pressure bearing portion is defined on a lower side of the sleeve 233. In this case, an axial magnetic center of a stator 210 is arranged at a level lower than that of an axial magnetic center of a rotor magnet 223. A magnetic attraction force that attracts the rotor magnet 223 downward is thereby generated between the stator 210 and the rotor magnet 223. This contributes to reducing a force that lifts a rotating portion 22 relative to a stationary portion 21 during rotation of a blower fan 1. The bearing mechanism 4 according to the present modification of the first preferred embodiment is otherwise similar in structure to the bearing mechanism 4 illustrated in FIG. 2.

Figure 9:
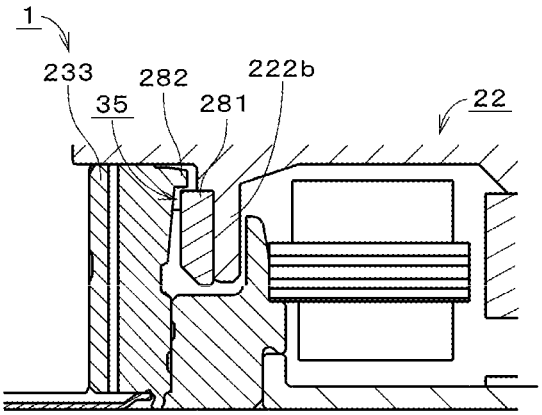
FIG. 9 is a cross-sectional view of a motor and its vicinity according to another modification of the first preferred embodiment.

Referring to FIG. 9, a tubular member 281 may be arranged on an inner circumferential surface of a rotor cylindrical portion 222*b* in a blower fan 1 according to a modification of the first preferred embodiment. In this modification of the first preferred embodiment, a sleeve 233 includes a projecting portion 282 arranged to project radially outward from a top portion of an outer circumferential surface thereof, and no thrust plate is arranged on a lower end of a shaft 221. The tubular member 281 and the projecting portion 282 are arranged axially opposite each other. A seal gap 35 is defined between an inner circumferential surface of the tubular member 281 and an outer circumferential surface of the sleeve 233. The seal gap 35 has a surface of a lubricating oil defined therein. The blower fan 1 according to the present modification of the first preferred embodiment is otherwise similar in structure to the blower fan 1 illustrated in FIG. 8. Even if a force that acts to move a rotating portion 22 upward is generated during drive of the blower fan 1, upward movement of the rotating portion 22 is prevented by axial contact between the projecting portion 282 and the tubular member 281.

Second Preferred Embodiment

Figure 10:
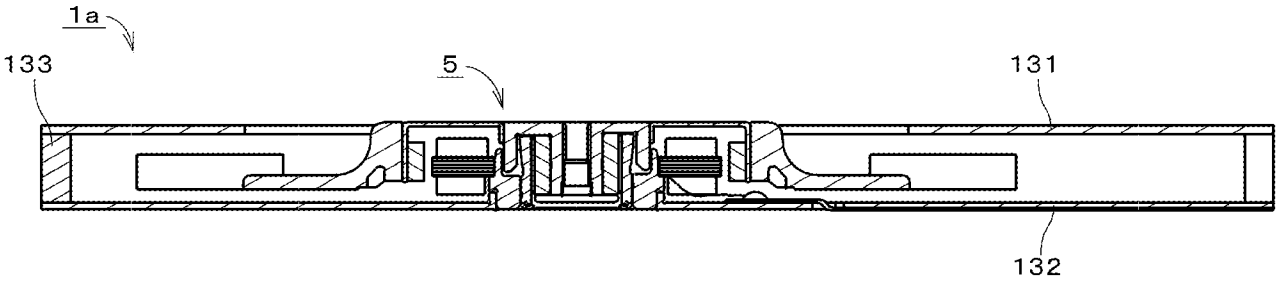
FIG. 10 is a cross-sectional view of a blower fan according to a second preferred embodiment of the present invention.
Figure 11:
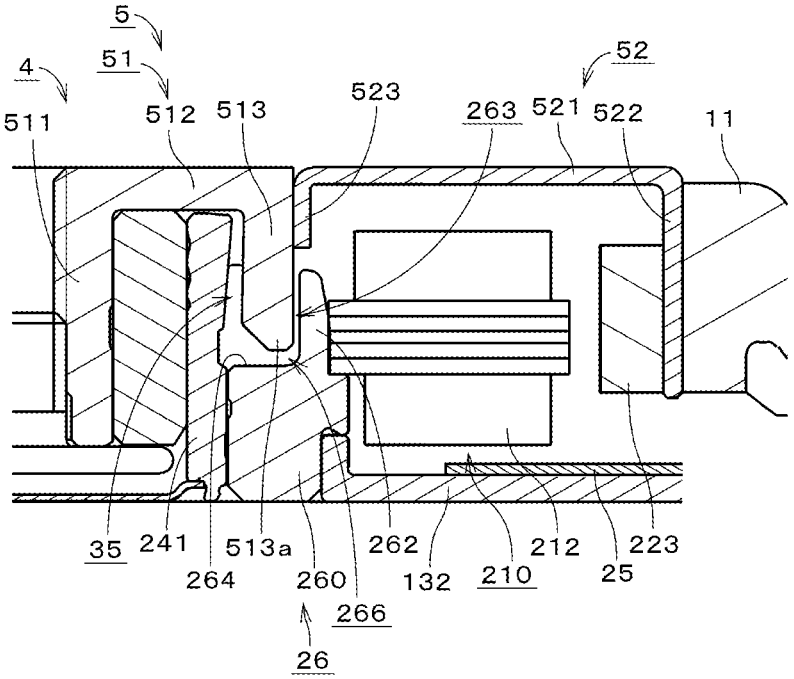
FIG. 11 is a cross-sectional view of the blower fan.

FIG. 10 is a cross-sectional view of a blower fan 1*a* according to a second preferred embodiment of the present invention. The blower fan 1*a* includes a rotor holder 5, which has a structure different from that of the rotor holder 222 of the blower fan 1 illustrated in FIG. 1. The blower fan 1*a* is otherwise similar in structure to the blower fan 1. Accordingly, like members or portions are designated by like reference numerals, and redundant description is omitted. FIG. 11 is a diagram illustrating a bearing mechanism 4 and its vicinity in an enlarged form. The rotor holder 5 includes a first holder member 51 and a second holder member 52. The first holder member 51 is arranged to define a portion of the bearing mechanism 4.

The first holder member 51 includes a shaft 511, a first thrust portion 512, and a rotor cylindrical portion 513. The rotor cylindrical portion 513 is arranged to extend downward from an outer edge portion of the first thrust portion 512. An outer circumferential surface of the first holder member 51 is a single cylindrical surface. An outer circumferential surface of the first thrust portion 512 is a top portion of the outer circumferential surface of the first holder member 51. An outer circumferential surface of the rotor cylindrical portion 513 is a portion of the outer circumferential surface of the first holder member 51 which is below the top portion thereof.

The second holder member 52 is a substantially plate-shaped annular member, and is molded by subjecting a metallic plate member to press working. The second holder member 52 includes a cover portion 521 and a "magnet holding cylindrical portion" 522. An inner edge portion of the cover portion 521 includes a "cover portion cylindrical portion" 523 arranged to extend downward. A rotor magnet 223 is fixed to an inner circumferential surface of the magnet holding cylindrical portion 522. An impeller 11 is fixed to an outer circumferential surface of the magnet holding cylindrical portion 522.

Regarding the rotor holder 5, the cover portion cylindrical portion 523 is press fitted to the rotor cylindrical portion 513, whereby the first holder member 51 is fixed to the second holder member 52.

When the blower fan 1*a* is assembled, the bearing mechanism 4 including the first holder member 51 is assembled beforehand. Note that, regarding the bearing mechanism 4, a lubricating oil is injected into a seal gap 35 before a bushing 26 is attached to a housing cylindrical portion 241.

Regarding the bearing mechanism 4, an annular surface 264 of a bushing base portion 260 is arranged axially opposite a lower end portion 513*a* of the rotor cylindrical portion 513. The annular surface 264 is arranged to cover the seal gap 35. The axial distance between the annular surface 264 and the lower end portion 513*a* of the rotor cylindrical portion 513, that is, a minimum axial width of a horizontal gap 266, is preferably arranged to be smaller than a maximum width of the seal gap 35. A vertical gap 263 extending in the axial direction is defined between an inner circumferential surface of a bushing cylindrical portion 262 and the outer circumferential surface of the rotor cylindrical portion 513. A minimum radial width of the vertical gap 263 is preferably arranged to be smaller than the maximum width of the seal gap 35. As in the first preferred embodiment, the bushing base portion 260 is an axially opposing portion, and the bushing cylindrical portion 262 is a radially opposing portion.

Next, a lower plate portion 132 is attached to a lower portion of an outer circumferential surface of the bushing 26. A stator 210 is attached to an upper portion of the outer circumferential surface of the bushing 26. Lead wires of coils 212 are connected to a circuit board 25 arranged on the lower plate portion 132.

Next, the rotor magnet 223 and the impeller 11 are fixed to the inner circumferential surface and the outer circumferential surface, respectively, of the magnet holding cylindrical portion 522 of the second holder member 52, and the cover portion cylindrical portion 523 is press fitted to the first holder member 51 from above the first holder member 51. Referring to FIG. 10, an upper plate portion 131 is thereafter attached to a side wall portion 133 fixed to the lower plate portion 132.

Also in the second preferred embodiment, the bushing 26 functions as a seal cover arranged to cover the seal gap 35, and the likelihood that dust will enter into the bearing mechanism 4 is thereby reduced. Because entry of dust into the bearing mechanism 4 is prevented when the bearing mechanism 4 is fitted to another member of the blower fan 1*a*, the fitting of the bearing mechanism 4 to the other member of the blower fan 1*a* does not need to be carried out in an extremely clean space. Even in the case where both assemblage of the bearing mechanism 4 and the fitting of the bearing mechanism 4 to the other member of the blower fan 1*a* are carried out in a clean room, covering of the seal gap 35 with the bushing 26 contributes to reducing the likelihood that an extraneous material will be adhered to a surface of the lubricating oil. As a result, an improvement in reliability of the bearing mechanism 4 is achieved.

An improvement in flexibility in assembling the blower fan 1*a* is achieved by the rotor holder 5 being made up of the first and second holder members 51 and 52, which are separate members.

In the case where the lower plate portion can be attached to the bushing only from above the bushing, the lower plate portion, the stator, and the second holder member, in the order named, need to be attached to the bearing mechanism. In contrast, in the case of the bearing mechanism 4, the lower plate portion 132 can be attached to the bushing 26 from below the bushing 26, and therefore, each of the stator 210 and the second holder member 52 may be attached to the bearing mechanism 4 either before or after the lower plate portion 132 is attached to the bearing mechanism 4. As a result, an improvement in flexibility in assembling the blower fan 1*a* is achieved.

Figure 12:
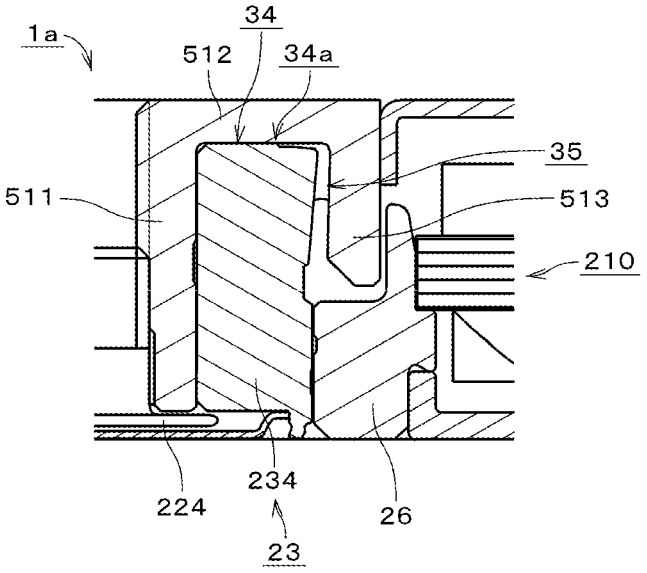
FIG. 12 is a diagram illustrating a bearing portion according to a modification of the second preferred embodiment.

FIG. 12 is a diagram illustrating a bearing portion 23 of a blower fan 1*a* according to a modification of the second preferred embodiment. The bearing portion 23 of the blower fan 1*a* may include a large sleeve 234 made of a metal, similarly to each of the bearing portions 23 illustrated in FIGS. 8 and 9. A bushing 26 is fixed to a lower portion of an outer circumferential surface of the sleeve 234. A seal gap 35 is defined between an upper portion of the outer circumferential surface of the sleeve 234 and an inner circumferential surface of a rotor cylindrical portion 513. The seal gap 35 has a surface of a lubricating oil defined therein. A first thrust gap 34 is defined between a lower surface of a first thrust portion 512 and an upper surface of the sleeve 234, and an upper thrust dynamic pressure bearing portion 34*a* is defined in the first thrust gap 34. Note that no thrust dynamic pressure bearing portion is defined between a second thrust portion 224 and a lower surface of the sleeve 234. The second thrust portion 224 is arranged to function as a portion that prevents a shaft 511 from coming off.

In the blower fan 1*a*, an axial magnetic center of a stator 210 is arranged at a level lower than that of an axial magnetic center of a rotor magnet 223 as is the case with FIG. 11, and a magnetic attraction force that attracts the rotor magnet 223 downward is thereby generated between the stator 210 and the rotor magnet 223. Also in the modification of the second preferred embodiment illustrated in FIG. 12, covering of the seal gap 35 with the bushing 26 contributes to preventing dust from entering into a bearing mechanism 4.

Figure 13:
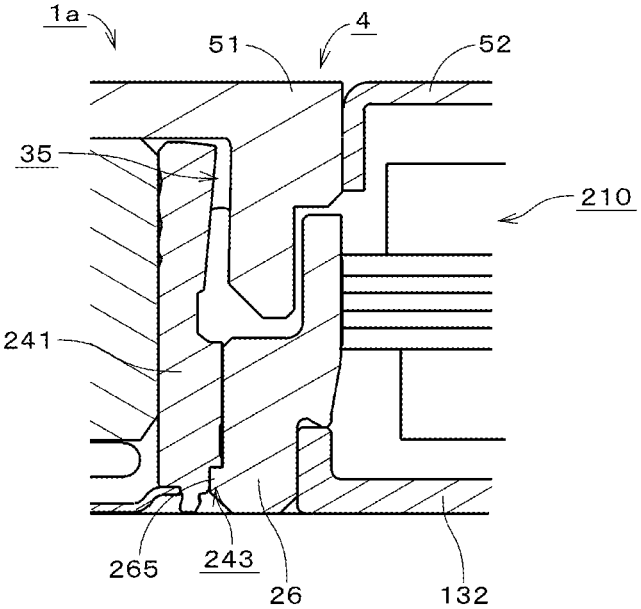
FIG. 13 is a diagram illustrating a bushing according to a modification of the second preferred embodiment.

FIG. 13 is a diagram illustrating a bearing mechanism 4 of a blower fan 1*a* according to a modification of the second preferred embodiment. In the blower fan 1*a*, a bushing 26 does not include the raised portion 261. In addition, a lower portion of the bushing 26 includes a projection 265 arranged to project radially inward. The blower fan 1*a* according to the present modification of the second preferred embodiment is otherwise similar in structure to the blower fan 1*a* illustrated in FIG. 10. A lower portion of an outer circumferential surface of a housing cylindrical portion 241 includes a shoulder portion 243 defined by a decrease in the diameter of the outer circumferential surface of the housing cylindrical portion 241. The projection 265 is arranged to be in axial contact with the shoulder portion 243. This makes it possible to attach the bushing 26 to the housing cylindrical portion 241 such that the bushing 26 is axially positioned with high precision relative to the housing cylindrical portion 241.

When the blower fan 1*a* is assembled, a stator 210 is attached to an outer circumferential surface of the bushing 26 from below the bearing mechanism 4. Next, a lower plate portion 132 is attached to the lower portion of the bushing 26. A second holder member 52 is press fitted to a first holder member 51 from above the first holder member 51. Also in the blower fan 1*a* according to the present modification of the second preferred embodiment, a seal gap 35 is covered with the bushing 26, and this contributes to preventing dust from entering into the bearing mechanism 4 when the blower fan 1*a* is assembled. Note that, in the case of the blower fan 1*a*, the stator 210 may be attached to the outer circumferential surface of the bushing 26 from above the bearing mechanism 4.

Figure 14:
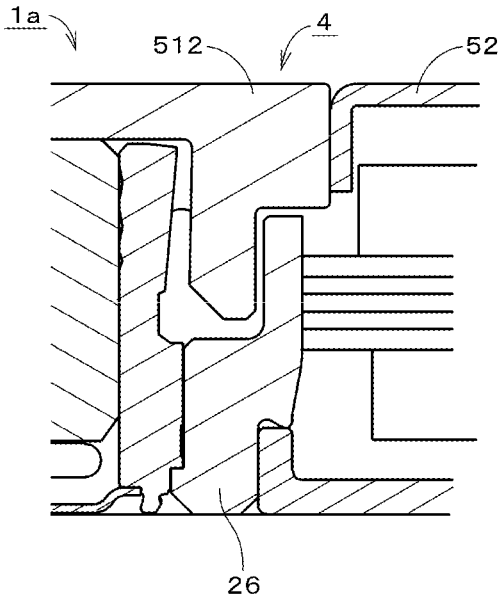
FIG. 14 is a diagram illustrating a first holder member according to a modification of the second preferred embodiment.

FIG. 14 is a diagram illustrating a bearing mechanism 4 of a blower fan 1*a* according to a modification of the second preferred embodiment. A bushing 26 of the blower fan 1*a* is arranged to have an outside diameter smaller than that of a first thrust portion 512. The bearing mechanism 4 according to the present modification of the second preferred embodiment is otherwise similar in structure to the bearing mechanism 4 illustrated in FIG. 13. When the blower fan 1*a* is assembled, it is possible to attach a second holder member 52 to the first thrust portion 512 with an outer edge portion of the first thrust portion 512 supported from below. Thus, assemblage of the blower fan 1*a* can be accomplished easily.

Third Preferred Embodiment

Figure 15:
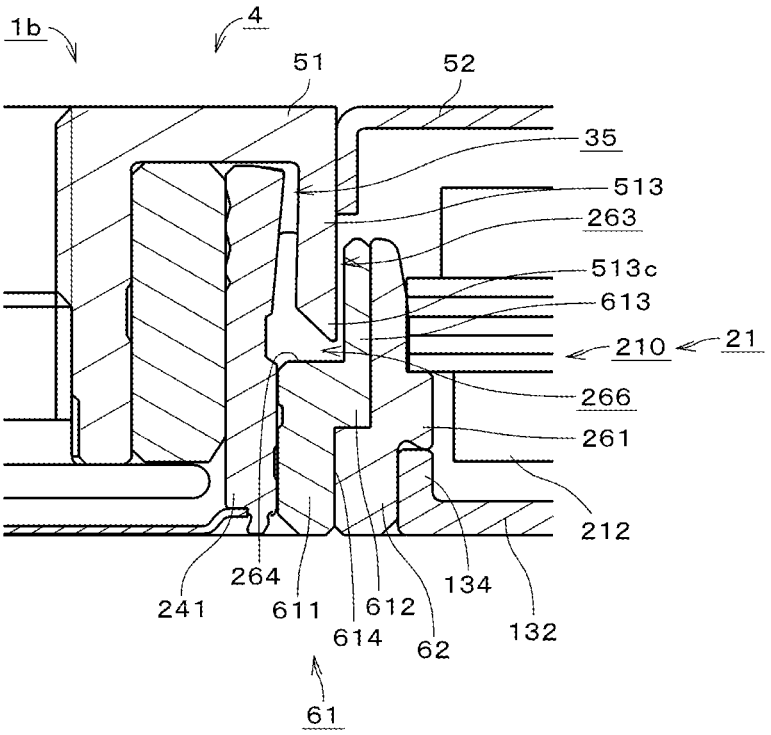
FIG. 15 is a cross-sectional view of a blower fan according to a third preferred embodiment of the present invention.

FIG. 15 is a diagram illustrating a blower fan 1*b* according to a third preferred embodiment of the present invention. A stationary portion 21 includes an inner bushing 61 and an outer bushing 62. In the case where a bearing mechanism 4 is considered to be a component of a motor, the inner bushing 61 is a portion of the bearing mechanism 4, while the outer bushing 62 is a portion of the stationary portion 21. The blower fan 1*b* is otherwise similar in structure to the blower fan 1*a* according to the second preferred embodiment. Accordingly, like members or portions are designated by like reference numerals, and redundant description is omitted.

The inner bushing 61 is arranged in an annular shape, and includes a tubular bushing base portion 611, a bushing annular portion 612, and a bushing upper cylindrical portion 613. The bushing base portion 611 is fixed to an outer circumferential surface of a housing cylindrical portion 241 through adhesion or press fit. Note that both adhesion and press fit may be used. The bushing annular portion 612 is arranged to extend radially outward from an upper end of the bushing base portion 611. That is, the bushing annular portion 612 is arranged to extend radially outward from an outer circumferential surface of a bearing portion 23. A horizontal gap 266 is defined between the bushing annular portion 612 and a lower end portion 513*c* of a rotor cylindrical portion 513.

The bushing upper cylindrical portion 613 is arranged to extend upward continuously from an outer edge portion of the bushing annular portion 612. The bushing annular portion 612 is an axially opposing portion arranged axially opposite the lower end portion 513*c* of the rotor cylindrical portion 513. The bushing annular portion 612 is arranged to cover a seal gap 35 defined between the rotor cylindrical portion 513 and the housing cylindrical portion 241. The axial distance between a tip of the rotor cylindrical portion 513 and an annular surface 264 arranged radially inside the bushing upper cylindrical portion 613, that is, a minimum axial width of the horizontal gap 266, is preferably arranged to be smaller than a maximum width of the seal gap 35.

The bushing upper cylindrical portion 613 is arranged radially outward of the rotor cylindrical portion 513. The bushing upper cylindrical portion 613 is a radially opposing portion arranged opposite to an outer circumferential surface of the rotor cylindrical portion 513. A minute vertical gap 263 extending in the axial direction is defined between an inner circumferential surface of the bushing upper cylindrical portion 613 and the outer circumferential surface of the rotor cylindrical portion 513. Provision of the vertical gap 263 contributes to reducing evaporation of a lubricating oil from the seal gap 35. A minimum radial width of the vertical gap 263 is preferably arranged to be smaller than the maximum width of the seal gap 35. The inner bushing 61 is a seal cover arranged to cover the seal gap 35.

The outer bushing 62 is substantially cylindrical in shape, and is fixed to an outer circumferential surface of the inner bushing 61. The outer bushing 62 includes an annular raised portion 261 arranged to project radially outward from an outer circumferential surface thereof. The raised portion 261 is arranged to extend continuously in the circumferential direction. A stator 210 is fixed to the outer circumferential surface of the outer bushing 62 on an upper side of the raised portion 261. The raised portion 261 and a lower end of a core back of the stator 210 are arranged to be in axial contact with each other. A lower plate cylindrical portion 134 of a lower plate portion 132 is fixed to the outer circumferential surface of the outer bushing 62 on a lower side of the raised portion 261. The raised portion 261 and the lower plate cylindrical portion 134 are arranged to be in axial contact with each other. Note that the raised portion 261 and the core back may be arranged to be out of contact with each other. Also note that the raised portion 261 and the lower plate cylindrical portion 134 may be arranged to be out of contact with each other. Lower ends of coils 212 are arranged at a level lower than that of a lower surface of the raised portion 261.

Preferably, a minute gap extending in the axial direction is defined between the outer bushing 62 and the bushing upper cylindrical portion 613. A minimum radial width of this minute gap is arranged to be smaller than the minimum radial width of the vertical gap 263. In the case where the bushing upper cylindrical portion 613 is fixed to the outer bushing 62 through press fit, the bushing upper cylindrical portion 613 may be deformed to bring the inner circumferential surface of the bushing upper cylindrical portion 613 into contact with the outer circumferential surface of the rotor cylindrical portion 513. Provision of the minute gap between the outer bushing 62 and the bushing upper cylindrical portion 613 contributes to preventing a deformation of the bushing upper cylindrical portion 613. This contributes to defining the vertical gap 263 with high precision.

The outer circumferential surface of the inner bushing 61 includes a shoulder portion including a downward facing surface, while an inner circumferential surface of the outer bushing 62 includes a shoulder portion including an upward facing surface. The outer bushing 62 can be attached to the inner bushing 61 from below the inner bushing 61. Relative axial positions of the inner bushing 61 and the outer bushing 62 are easily determined by axial contact between the shoulder portion of the inner bushing 61 and the shoulder portion of the outer bushing 62. The outer circumferential surface of the inner bushing 61 is an attachment surface 614 to which the lower plate portion 132 is attached indirectly.

When the blower fan 1*b* is assembled, the bearing mechanism 4 is assembled beforehand. At this time, the inner bushing 61 is fixed to the housing cylindrical portion 241, so that the seal gap 35 is covered with the inner bushing 61. Independently of assemblage of the bearing mechanism 4, each of the stator 210 and the lower plate portion 132 is fixed to the outer bushing 62. Then, lead wires of the coils 212 are connected to a circuit board 25 arranged on the lower plate portion 132. Thereafter, the outer bushing 62 is fixed to the outer circumferential surface of the inner bushing 61 from below the inner bushing 61, with the result that the bearing mechanism 4 and the stationary portion 21 are assembled as a single unit. Thereafter, a second holder member 52 is press fitted to a first holder member 51 from above the first holder member 51. Note that the second holder member 52 may be attached to the first holder member 51 before the outer bushing 62 is fixed to the inner bushing 61.

In the third preferred embodiment, similarly to the second preferred embodiment, the blower fan 1*b* is assembled with the seal gap 35 covered with the inner bushing 61, and this contributes to reducing the likelihood that dust will enter into the bearing mechanism 4 during assemblage of the blower fan 1*b*. The same is true of other preferred embodiments of the present invention described below. The vertical gap 263 being arranged radially outward of the seal gap 35 contributes to more securely preventing dust from entering into the bearing mechanism 4.

Figure 16:
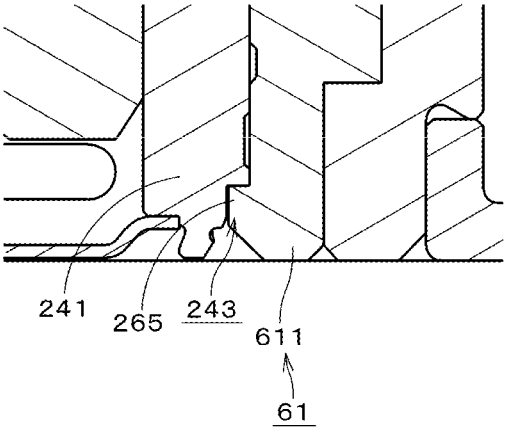
FIG. 16 is a diagram illustrating an inner bushing according to a modification of the third preferred embodiment.

FIG. 16 is a diagram illustrating an inner bushing 61 according to a modification of the third preferred embodiment. A lower portion of a bushing base portion 611 includes a projection 265 arranged to project radially inward. A lower portion of a housing cylindrical portion 241 includes a shoulder portion 243 defined by a decrease in the diameter of an outer circumferential surface of the housing cylindrical portion 241. The projection 265 is arranged to be in axial contact with the shoulder portion 243. Provision of the projection 265 makes it possible to attach the inner bushing 61 to the housing cylindrical portion 241 such that the inner bushing 61 is axially positioned with high precision relative to the housing cylindrical portion 241.

Figure 17:
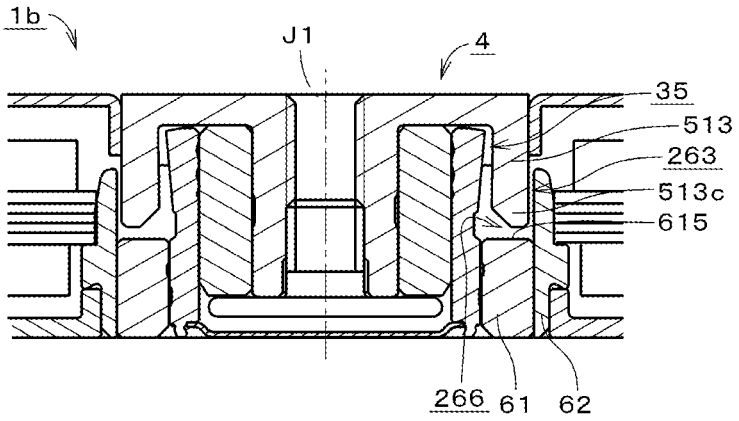
FIG. 17 is a diagram illustrating an inner bushing according to another modification of the third preferred embodiment.

FIG. 17 is a diagram illustrating an inner bushing 61 according to another modification of the third preferred embodiment. In FIG. 17, the inner bushing 61 is cylindrical in shape and centered on a central axis J1. An upper surface 615 of the inner bushing 61 is arranged axially opposite a lower end portion 513*c* of a rotor cylindrical portion 513 to cover a seal gap 35. This makes it possible to assemble a blower fan 1*b* while preventing dust from entering into a bearing mechanism 4. An upper portion of the inner bushing 61 is an axially opposing portion arranged to extend radially outward from an outer circumferential surface of a bearing portion 23, and arranged axially opposite the lower end portion 513*c* of the rotor cylindrical portion 513. A horizontal gap 266 is defined between the lower end portion 513*c* of the rotor cylindrical portion 513 and the upper portion of the inner bushing 61. A minimum width of the horizontal gap 266 is preferably arranged to be smaller than a maximum width of the seal gap 35. The same is true of FIGS. 18, 19, and 20, which will be described below.

An outer circumferential surface of the inner bushing 61 is arranged radially outward of an outer circumferential surface of the rotor cylindrical portion 513. An upper portion of an outer bushing 62 is arranged radially outside the rotor cylindrical portion 513. A minute vertical gap 263 extending in the axial direction is defined between an inner circumferential surface of the upper portion of the outer bushing 62 and the outer circumferential surface of the rotor cylindrical portion 513. Therefore, the inner bushing 61 is a seal cover that includes an axially opposing portion but does not include a radially opposing portion. The outer bushing 62 functions as an indirect seal cover which includes the radially opposing portion. The same is true of FIGS. 18 to 20, which will be described below. A minimum width of the vertical gap 263 is preferably arranged to be smaller than the maximum width of the seal gap 35.

In the case where the inner bushing 61 includes only the axially opposing portion without including the radially opposing portion, the outer circumferential surface of the inner bushing 61 is as a rule an attachment surface to which a lower plate portion 132 is attached indirectly, in order to enable the vertical gap to be defined or to enable a stator 210 to be fixed beforehand. However, the lower plate portion 132 may be directly attached to the outer circumferential surface of the inner bushing 61, with the stator 210 fixed on the lower plate portion 132, for example.

Figure 18:
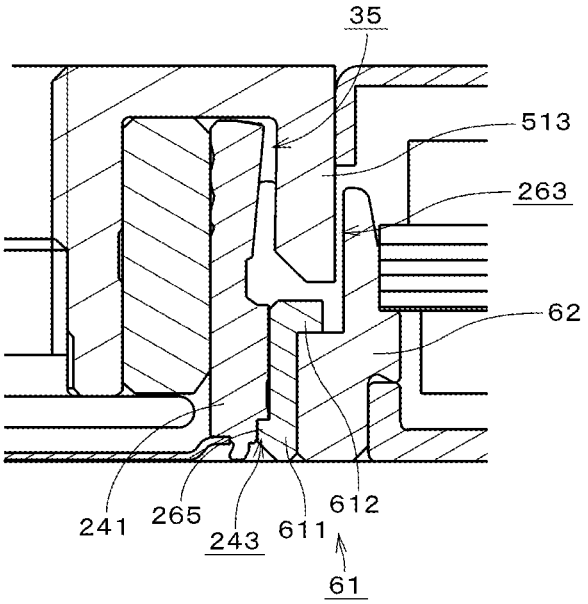
FIG. 18 is a diagram illustrating an inner bushing according to yet another modification of the third preferred embodiment.

FIG. 18 is a diagram illustrating an inner bushing 61, which is a seal cover, according to yet another modification of the third preferred embodiment. The inner bushing 61 includes a tubular bushing base portion 611 fixed to an outer circumferential surface of a housing cylindrical portion 241, and a bushing annular portion 612 arranged to extend radially outward from an upper end of the bushing base portion 611. The inner bushing 61 is arranged axially opposite a lower end portion of a rotor cylindrical portion 513. More specifically, the bushing annular portion 612 is arranged axially opposite the lower end portion of the rotor cylindrical portion 513. The bushing annular portion 612 is arranged to cover a seal gap 35.

Similarly to the lower portion of the bushing base portion 611 illustrated in FIG. 16, a lower portion of the bushing base portion 611 according to the present modification of the third preferred embodiment includes a projection 265 arranged to project radial inward. The projection 265 is arranged to be in axial contact with a shoulder portion 243 defined in a lower portion of the housing cylindrical portion 241. Similarly to the lower surface of the bushing annular portion 612 illustrated in FIG. 15, a lower surface of the bushing annular portion 612 according to the present modification of the third preferred embodiment is arranged to be in axial contact with an upward facing surface of a shoulder portion included in an inner circumferential surface of an outer bushing 62. Meanwhile, as with the modification of the third preferred embodiment illustrated in FIG. 17, a minute vertical gap 263 extending in the axial direction is defined between an inner circumferential surface of an upper portion of the outer bushing 62 and an outer circumferential surface of the rotor cylindrical portion 513.

Figure 19:
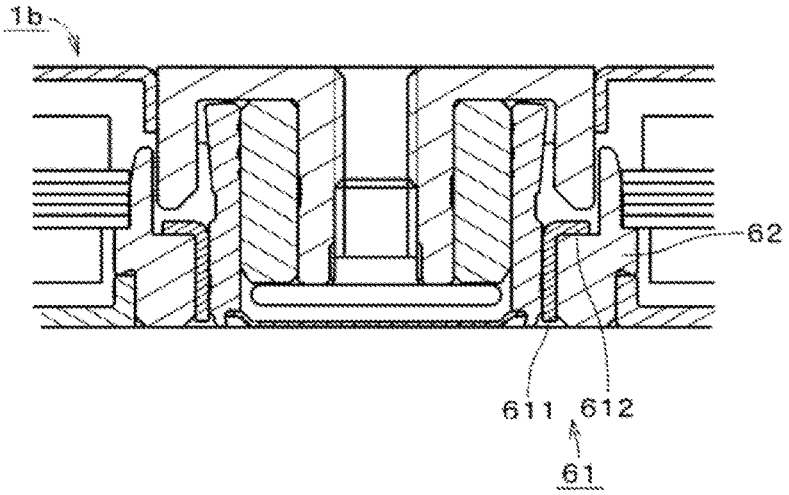
FIG. 19 is a diagram illustrating an inner bushing according to yet another modification of the third preferred embodiment.

FIG. 19 is a diagram illustrating an inner bushing 61 according to yet another modification of the third preferred embodiment. The inner bushing 61 is molded by subjecting a thin metallic plate to press working, and includes a bushing base portion 611 and a bushing annular portion 612. An outer bushing 62 according to the present modification of the third preferred embodiment is similar to the outer bushing 62 according to the modification of the third preferred embodiment illustrated in FIG. 18. The inner bushing 61 of a blower fan 1*b* according to the present modification of the third preferred embodiment can be produced more easily and at a lower cost by employing the press working than in the case where a cutting process is employed instead. An outer circumferential surface of the bushing annular portion 612 is arranged to be out of contact with the outer bushing 62. That is, the bushing annular portion 612 and the outer bushing 62 are arranged radially opposite each other with a gap intervening therebetween. Thus, the outer bushing 62 can be attached to the inner bushing 61 with high precision.

Figure 20:
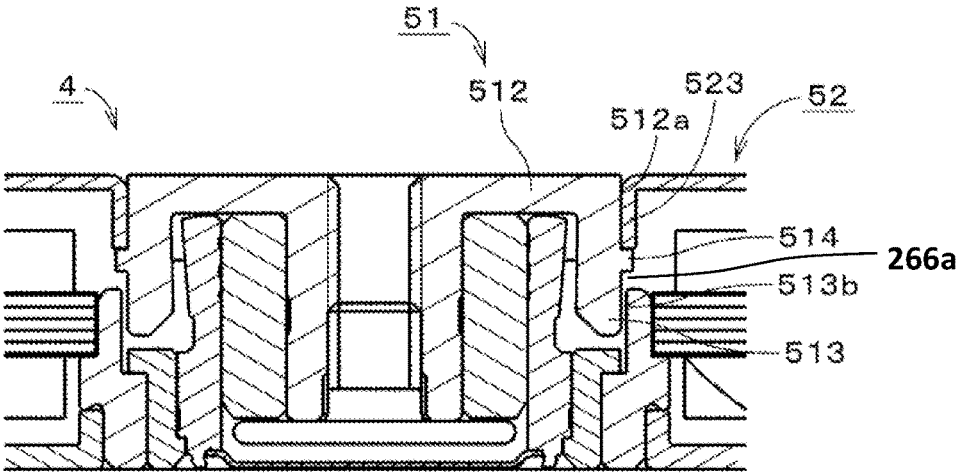
FIG. 20 is a diagram illustrating a first holder member according to a modification of the third preferred embodiment.

FIG. 20 is a diagram illustrating a bearing mechanism 4 according to yet another modification of the third preferred embodiment. A rotor cylindrical portion 513 of a first holder member 51 includes an annular "rotor raised portion" 514 arranged to project radially outward from an outer circumferential surface thereof. As in each of the preferred embodiments of the present invention illustrated in FIGS. 11 and 19, an outer circumferential surface 513b of the rotor cylindrical portion 513 is arranged to have a diameter equal to that of an outer circumferential surface 512*a* of a first thrust portion 512, except in the rotor raised portion 514. A lower end portion of a "cover portion cylindrical portion" 523 of a second holder member 52 is arranged to be in axial contact with the rotor raised portion 514. When the second holder member 52 is attached to the first holder member 51, the cover portion cylindrical portion 523 is press fitted to the rotor cylindrical portion 513 in a situation in which the rotor raised portion 514 is supported from below by a jig. Provision of the rotor raised portion 514 makes it possible to attach the second holder member 52 to the first holder member 51 such that the second holder member 52 is axially positioned with high precision relative to the first holder member 51. Note that the diameter of the outer circumferential surface 512*a* of the first thrust portion 512 may be arranged to be smaller than the diameter of the outer circumferential surface 513*b* of the rotor cylindrical portion 513. The lower end portion of the rotor raised portion 514 and the upper end portion of the bushing cylindrical portion 262 are arranged to together define another horizontal gap 266*a*.

Figure 21:
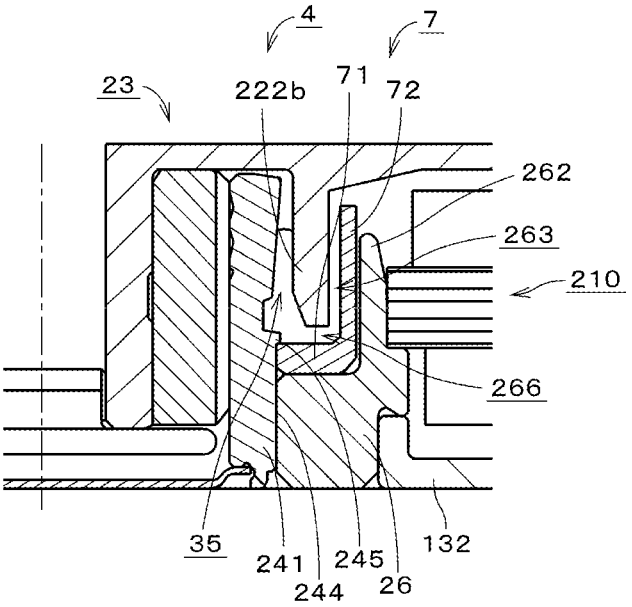
FIG. 21 is a diagram illustrating a bearing mechanism according to another modification of the third preferred embodiment.

FIG. 21 is a diagram illustrating a bearing mechanism 4 according to yet another modification of the third preferred embodiment. In this bearing mechanism 4, a seal cover 7 is additionally provided compared to the bearing mechanism 4 illustrated in FIG. 2. The seal cover 7 is attached to an outer circumferential surface of a housing cylindrical portion 241, and is arranged radially inside a bushing cylindrical portion 262. Accordingly, the shape of a bushing 26 is different from that of the bushing 26 illustrated in FIG. 2. In FIG. 21, the bushing 26 does not function as the seal cover.

The seal cover 7 includes an axially opposing portion 71 and a radially opposing portion 72. The seal cover 7 is defined by a single continuous member. The axially opposing portion 71 is arranged in the shape of an annular plate, and is arranged to extend radially outward from an outer circumferential surface of a bearing portion 23. Note that the axially opposing portion 71 may not necessarily be in the shape of a plate as long as the axially opposing portion 71 is in an annular shape. The axially opposing portion 71 is arranged axially opposite a lower end portion of a rotor cylindrical portion 222*b*. The axially opposing portion 71 and the lower end portion of the rotor cylindrical portion 222*b* are arranged to together define a horizontal gap 266 therebetween. A minimum width of the horizontal gap 266 is arranged to be smaller than a maximum width of a seal gap 35. The radially opposing portion 72 is arranged to extend upward continuously from an outer edge portion of the axially opposing portion 71. The radially opposing portion 72 is arranged in the shape of a cylinder. The radially opposing portion 72 is arranged radially outside the rotor cylindrical portion 222*b*, and is arranged radially opposite an outer circumferential surface of the rotor cylindrical portion 222*b*. The rotor cylindrical portion 222*b* and the radially opposing portion 72 are arranged to together define a vertical gap 263 therebetween. A minimum width of the vertical gap 263 is also arranged to be smaller than the maximum width of the seal gap 35.

The axially opposing portion 71 is fixed to the outer circumferential surface of the housing cylindrical portion 241. The bushing 26 is fixed to the outer circumferential surface of the housing cylindrical portion 241 on a lower side of the axially opposing portion 71. Therefore, a portion of the outer circumferential surface of the bearing portion 23 which is below the seal cover 7 is an attachment surface 244 to which a lower plate portion 132 arranged to support the bearing portion 23 is attached indirectly.

The outer circumferential surface of the housing cylindrical portion 241 of the bearing portion 23 includes a projection 245 arranged to project radially outward. The projection 245 may be either arranged to extend in an annular shape, occupying every circumferential position, or made up of a projection or projections arranged at a circumferential position or positions. The projection 245 is arranged to be in axial contact with an upper portion of the axially opposing portion 71. The axial position of the seal cover 7 relative to the bearing portion 23 can thereby be determined easily.

A blower fan in which the bearing mechanism 4 illustrated in FIG. 21 is adopted is assembled in a manner substantially similar to that in which the blower fan according to the third preferred embodiment is assembled. That is, when the bearing mechanism 4 is assembled, the seal cover 7 is fixed to the housing cylindrical portion 241, so that the seal gap 35 is covered with the seal cover 7. Independently of assemblage of the bearing mechanism 4, each of a stator 210 and the lower plate portion 132 is fixed to the bushing 26. Then, the bushing 26 is fixed to the outer circumferential surface of the housing cylindrical portion 241.

Also in the case of the bearing mechanism 4 illustrated in FIG. 21, the blower fan is assembled in a situation in which the seal gap 35 is covered with the seal cover 7, and this contributes to reducing the likelihood that dust will enter into the bearing mechanism 4 during assemblage of the blower fan. In particular, the vertical gap 263 being arranged radially outward of the seal gap 35 contributes to more securely preventing dust from entering into the bearing mechanism 4.

Figure 22:
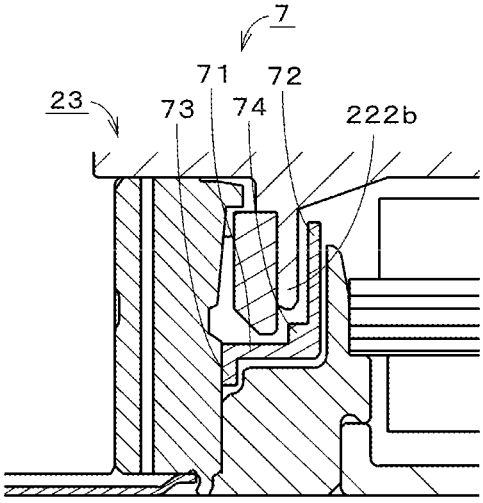
FIG. 22 is a diagram illustrating a seal cover according to a modification of the third preferred embodiment.

FIG. 22 is a diagram illustrating a seal cover 7 according to another modification of the third preferred embodiment. The seal cover 7 includes an axially opposing portion 71 and a radially opposing portion 72, similarly to the seal cover 7 illustrated in FIG. 21, and further includes a lower cylindrical portion 73 and an expanded portion 74. The seal cover 7 is defined by a single member.

The lower cylindrical portion 73 is arranged to extend downward from an inner circumferential portion of the axially opposing portion 71, which is arranged in the shape of an annular plate. An inner circumferential surface of the lower cylindrical portion 73 is arranged to be in contact with an outer circumferential surface of a bearing portion 23. The seal cover 7 is thereby securely fixed to the bearing portion 23. In addition, an improvement in parallelism of the radially opposing portion 72 with a central axis J1 is thereby achieved to prevent a contact between a rotor cylindrical portion 222*b* and the radially opposing portion 72.

Figure 23:
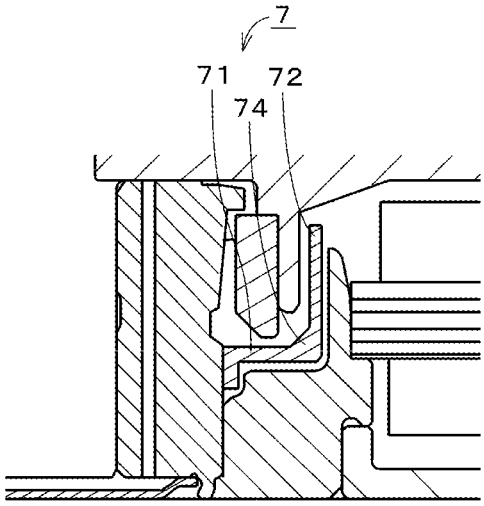
FIG. 23 is a diagram illustrating a seal cover according to another modification of the third preferred embodiment.

The expanded portion 74 is arranged at a junction between the axially opposing portion 71 and the radially opposing portion 72. The expanded portion 74 can be considered to be a portion defined by an increased axial width of the axially opposing portion 71 relative to the axial width of a remaining portion of the axially opposing portion 71. Since the axially opposing portion 71 expands upward in the expanded portion 74, the expanded portion 74 can also be considered to be a portion defined by an increased radial width of the radially opposing portion 72. Although the expanded portion 74 illustrated in FIG. 22 is defined by a radially outward stepwise increase in the axial width of the axially opposing portion 71, the manner of the increase in the axial width of the axially opposing portion 71 may be modified in a variety of manners. For example, referring to FIG. 23, the expanded portion 74 may be defined by a gradual radially outward increase in the axial width of the axially opposing portion 71.

Provision of the expanded portion 74 contributes to increasing rigidity of the seal cover 7 at the junction between the axially opposing portion 71 and the radially opposing portion 72, and thereby improving strength of the seal cover 7. Note that only one of the lower cylindrical portion 73 and the expanded portion 74 may be provided as necessary in another modification of the third preferred embodiment.

The bearing portion 23 illustrated in FIG. 21 has a structure similar to that of the bearing portion 23 illustrated in FIG. 2, and the bearing portion 23 illustrated in FIG. 22 has a structure similar to that of the bearing portion 23 illustrated in FIG. 9. Note that each of the bearing portions 23 illustrated in FIGS. 21 and 22 may be modified to have the structure of any of the bearing portions 23 illustrated in FIGS. 2, 8, and 9 or any other desired structure. Also note that the structure of the rotor holder 5 may be modified in such a manner that the rotor holder 5 includes the first and second holder members 51 and 52 as illustrated in FIG. 10, or that the rotor holder 5 may be modified to have another structure. In the case where the rotor holder 5 is modified to have the structure as illustrated in FIG. 10, the seal cover 7 is preferably arranged to have an outside diameter smaller than that of the first thrust portion 512, similarly to the bushing 26 illustrated in FIG. 14. Furthermore, the radially opposing portion 72 may be eliminated from the seal cover 7, with the result that the seal cover 7 defines only the horizontal gap 266 with the axially opposing portion 71.

While preferred embodiments of the present invention have been described above, the present invention is not limited to the above-described preferred embodiments, but a variety of modifications are possible.

In the bearing mechanism 4 illustrated in FIG. 2, the first thrust dynamic pressure groove array 273 is defined in the upper surface 231*b* of the sleeve 231. Note, however, that the first thrust dynamic pressure groove array 273 may be defined in an upper surface of the bearing housing 232. In this case, an upper thrust dynamic pressure bearing portion 34*a* is defined between the lower surface of the first thrust portion 222*d* and a portion of the upper surface of the bearing housing 232 in which the first thrust dynamic pressure groove array 273 is defined. Also note that thrust portions arranged opposite to the bearing portion 23 to define thrust dynamic pressure bearing portions are not limited to the thrust portions according to the above-described preferred embodiments, as long as the thrust portions are arranged around the shaft in the annular shape. The same is true of the bearing mechanisms 4 according to the other preferred embodiments of the present invention.

Note that each of the first and second radial dynamic pressure groove arrays may be defined in the outer circumferential surface of the shaft 221 in a modification of any of the above-described preferred embodiments. Also note that the first thrust dynamic pressure groove array may be defined in the lower surface of the first thrust portion 222*d*. Also note that the second thrust dynamic pressure groove array may be defined in the upper surface of the second thrust portion 224. Also note that the first thrust dynamic pressure groove array may be made up of a collection of grooves arranged in the herringbone pattern. Also note that the second thrust dynamic pressure groove array may also be made up of a collection of grooves arranged in the herringbone pattern.

In a modification of the third preferred embodiment, only one thrust dynamic pressure bearing portion, i.e., the upper thrust dynamic pressure bearing portion, may be provided as in each of the preferred embodiments of the present invention illustrated in FIGS. 9 and 12. Also note that the sleeve 231 and the housing cylindrical portion 241 may be defined by a single member. Also note that, in a modification of the first preferred embodiment, the bushing may be made up of an inner bushing and an outer bushing. In this case, when the blower fan 1 is assembled, the bearing mechanism including the inner bushing is assembled, and the outer bushing having the stator 210 and the lower plate portion 132 attached thereto is fixed to the inner bushing. The blower fan 1 can thus be assembled while preventing dust from entering into the bearing mechanism 4.

Note that, in a modification of the first preferred embodiment, the outer circumferential surface of the bushing 26 may be a cylindrical surface centered on the central axis J1. Also note that the diameter of the outer circumferential surface of the bushing 26 may be arranged to gradually increase with increasing height. Even in this case, it is possible to attach the lower plate portion 132 to the bushing 26 from below the bushing 26. The same is true of the second preferred embodiment. Also note that, in a modification of the third preferred embodiment, the outer circumferential surface of the outer bushing 62 may be a cylindrical surface centered on the central axis J1. Also note that the diameter of the outer circumferential surface of the outer bushing 62 may be arranged to gradually increase with increasing height.

Note that the downward facing surface which is arranged opposite to the upper surface of the second thrust portion 224 in the plate accommodating portion 239 is not limited to the lower surface of the sleeve 231. That is, the lower thrust dynamic pressure bearing portion may be defined between the second thrust portion 224 and a member other than the sleeve 231.

Note that, in a modification of any of the preferred embodiments illustrated in FIGS. 2, 11, 15, and the like, the outer circumferential surface of the bearing portion 23 may be arranged to include a projection arranged to project radially outward and which is arranged to be in axial contact with an upper portion of an inner circumferential portion of the bushing 26 or the inner bushing 61 which functions as the axially opposing portion. The axial position of the bushing 26 or the inner bushing 61 relative to the bearing portion 23 can thereby be determined easily.

The blower fan 1 is used to cool electronic components in a slim device, such as a tablet personal computer, a notebook personal computer, or the like.

Bearing mechanisms according to preferred embodiments of the present invention may be used in motors used for a variety of purposes. Blower fans including the bearing mechanisms according to preferred embodiments of the present invention may be used, for example, to cool electronic components in cases, or to supply air to a variety of objects. Furthermore, the blower fans may be used for other purposes as well.

What is claimed is:

1. A blower fan comprising:

a motor;

an impeller caused by the motor to rotate about a central axis; and a housing arranged to contain the motor and the impeller; wherein the motor includes:

a stationary portion;

a bearing apparatus; and a rotating portion supported by the bearing apparatus to be rotatable with respect to the stationary portion;

the rotating portion includes a rotor holder including a first holder member and a second holder member including an outer circumferential surface to which the impeller is fixed;

the first holder member includes:

a first thrust portion; and a rotor cylindrical portion arranged to extend downward from an outer edge portion of the first thrust portion;

the second holder member includes a cover portion including, in an inner edge portion thereof, a cover cylindrical portion arranged to extend downward;

the rotor cylindrical portion includes an annular rotor raised portion arranged to project radially outward from an outer circumferential surface thereof;

the second holder member is attached to the first holder member; and a lower end portion of the cover cylindrical portion is arranged to be in axial contact with the rotor raised portion, the bearing apparatus includes:

a bearing portion including a bearing housing including a housing cylindrical portion being substantially cylindrical in shape and centered on the central axis; and a substantially annular bushing, an inner circumferential surface of the bushing is fixed to a lower portion of an outer circumferential surface of the bearing housing through adhesion or press fit;

an inner circumferential surface of the rotor cylindrical portion and an outer circumferential surface of the bearing portion are arranged to together define a seal gap therebetween, the seal gap including a seal portion having a surface of a lubricating oil defined therein;

the bushing includes:

a bushing base portion arranged axially opposite a lower end portion of the rotor cylindrical portion; and a bushing cylindrical portion being substantially cylindrical in shape, and arranged to extend upward from an upper portion of the bushing base portion;

an inner circumferential surface of the bushing cylindrical portion and the outer circumferential surface of the rotor cylindrical portion are arranged to together define a vertical gap extending in an axial direction therebetween;

the vertical gap is arranged to have a minimum radial width equal to or smaller than a maximum width of the seal gap, the bushing cylindrical portion is arranged axially opposite the rotor raised portion; and a lower end portion of the rotor raised portion and an upper end portion of the bushing cylindrical portion are arranged to together define a horizontal gap therebetween.

2. The blower fan according to claim 1, wherein an outer end of the rotor raised portion is arranged radially inward of an outer circumferential surface of the cover cylindrical portion.

3. The blower fan according to claim 1, wherein the cover cylindrical portion is press fitted to the rotor cylindrical portion.

4. The blower fan according to claim 1, wherein the substantially annular bushing has a stator attached to an outer circumferential surface thereof; and the bushing base portion includes an annular surface arranged to cover the seal gap.

5. The blower fan according to claim 4, wherein the bushing base portion and the lower end portion of the rotor cylindrical portion are arranged to together define an additional horizontal gap therebetween, the additional horizontal gap having a minimum axial width equal to or smaller than a maximum width of the seal gap.

6. The blower fan according to claim 4, wherein the bushing comprises an inner bushing and an outer bushing, said bushing base portion provided in the inner bushing, wherein the inner bushing has a bushing annular portion arranged to extend radially outward from an upper end of the bushing base portion of the inner bushing.

7. The blower fan according to claim 1, wherein the bushing cylindrical portion, the rotor raised portion, and the cover cylindrical portion are arranged axially opposite one another.

8. The blower fan according to claim 1, wherein and the bushing includes an annular raised portion arranged to project radially outward from an outer circumferential surface thereof.

9. The blower fan according to claim 8, wherein the raised portion is defined by a single continuous portion extending continuously in a circumferential direction.

10. The blower fan according to claim 8, wherein the stationary portion includes a lower plate portion being a member produced by subjecting a metal sheet to press working;

the lower plate portion includes a lower plate cylindrical portion being substantially cylindrical in shape and centered on the central axis; and the lower plate cylindrical portion is fixed to a portion of the outer circumferential surface of the bushing which is below the raised portion through press fit.

11. The blower fan according to claim 1, wherein the substantially annular bushing has a stator attached to an outer circumferential surface thereof;

a lower portion of an outer circumferential surface of the housing cylindrical portion includes a shoulder portion defined by a decrease in a diameter of the outer circumferential surface of the housing cylindrical portion;

a lower portion of the bushing includes a projection arranged to project radially inward;

the bushing is attached to the housing cylindrical portion; and the projection is arranged to be in axial contact with the shoulder portion.

12. A blower fan comprising:

a motor;

an impeller caused by the motor to rotate about a central axis; and a housing arranged to contain the motor and the impeller; wherein the motor includes:

a stationary portion;

a bearing apparatus; and a rotating portion supported by the bearing apparatus to be rotatable with respect to the stationary portion;

the rotating portion includes a rotor holder including a first holder member and a second holder member including an outer circumferential surface such that the impeller is located radially outside of the outer circumferential surface;

the first holder member includes:

a first thrust portion; and a rotor cylindrical portion arranged to extend downward from an outer edge portion of the first thrust portion;

the second holder member includes a cover portion including, in an inner edge portion thereof, a cover cylindrical portion arranged to extend downward;

the rotor cylindrical portion includes an annular rotor raised portion arranged to project radially outward from an outer circumferential surface thereof;

the second holder member is attached to the first holder member; and a lower end portion of the cover cylindrical portion is arranged to be in axial contact with the rotor raised portion, the bearing apparatus includes:

a bearing portion including a bearing housing including a housing cylindrical portion being substantially cylindrical in shape and centered on the central axis; and a substantially annular bushing, an inner circumferential surface of the bushing is fixed to a lower portion of an outer circumferential surface of the bearing housing through adhesion or press fit;

an inner circumferential surface of the rotor cylindrical portion and an outer circumferential surface of the bearing portion are arranged to together define a seal gap therebetween, the seal gap including a seal portion having a surface of a lubricating oil defined therein;

the bushing includes:

a bushing base portion arranged axially opposite a lower end portion of the rotor cylindrical portion; and a bushing cylindrical portion being substantially cylindrical in shape, and arranged to extend upward from an upper portion of the bushing base portion;

an inner circumferential surface of the bushing cylindrical portion and the outer circumferential surface of the rotor cylindrical portion are arranged to together define a vertical gap extending in an axial direction therebetween; and the vertical gap is arranged to have a minimum radial width equal to or smaller than a maximum width of the seal gap, the bushing cylindrical portion is arranged axially opposite the rotor raised portion; and a lower end portion of the rotor raised portion and an upper end portion of the bushing cylindrical portion are arranged to together define a horizontal gap therebetween.

* * * * *